US010017934B2

(12) United States Patent
Getz

(10) Patent No.: US 10,017,934 B2
(45) Date of Patent: Jul. 10, 2018

(54) SYSTEMS AND METHODS FOR BRACKET CONFIGURATIONS OF A FRAMING ASSEMBLY

(71) Applicant: Jeffrey Getz, Phoenix, AZ (US)

(72) Inventor: Jeffrey Getz, Phoenix, AZ (US)

( * ) Notice: Subject to any disclaimer, the term of this patent is extended or adjusted under 35 U.S.C. 154(b) by 0 days.

(21) Appl. No.: 15/661,578

(22) Filed: Jul. 27, 2017

(65) Prior Publication Data

US 2018/0094422 A1 Apr. 5, 2018

Related U.S. Application Data

(60) Provisional application No. 62/403,936, filed on Oct. 4, 2016, provisional application No. 62/454,378, filed on Feb. 3, 2017.

(51) Int. Cl.
*E04B 1/38* (2006.01)
*E04B 1/24* (2006.01)
(Continued)

(52) U.S. Cl.
CPC ..... *E04B 1/2403* (2013.01); *E04B 1/40* (2013.01); *E04C 3/06* (2013.01);
(Continued)

(58) Field of Classification Search
CPC ..... E04B 1/2403; E04B 2001/2415; E04B 1/2608; E04B 2/763; E04B 2/761; E04B 2/767; E04B 2001/2448; E04B 5/14
(Continued)

(56) References Cited

U.S. PATENT DOCUMENTS 3,103,263 A 9/1963 Leeser
4,464,074 A * 8/1984 Green ..... E04B 1/2403 211/182
(Continued)

FOREIGN PATENT DOCUMENTS

GB 192837 2/1923
GB 2463319 3/2010
(Continued)

OTHER PUBLICATIONS

Connectors for Cold-Farmed Steel Construction, C-CFS-15, 2015, 172 pages.
(Continued)

*Primary Examiner* — Chi Q Nguyen
(74) *Attorney, Agent, or Firm* — Polsinelli PC; Ari M. Bai

(57) ABSTRACT

A framing assembly is disclosed. The framing assembly includes a bracket defining a first bracket section and a second bracket section aligned in perpendicular relation relative to the first bracket section along a bracket bend. The bracket includes a first slit and a second slit formed along the second bracket section. The first slit and the second slit define a tapered or triangular shape. The first bracket section includes a plurality of linear sides and corners defined along the linear sides. The first bracket section may be coupled to a joist by disposing the first bracket section within an interior portion of a joist defined by a web, flanges, and returns of the joist. The linear sides and the corners of the bracket facilitate the bracket to snap in place within the interior portion of the joist and the first slit and the second slit receive the returns of the joist.

26 Claims, 19 Drawing Sheets

(51) Int. Cl.
*E04C 3/06* (2006.01)
*E04B 1/41* (2006.01)

(52) U.S. Cl.
CPC ..... *E04B 2001/2415* (2013.01); *E04B 2001/2466* (2013.01); *E04B 2001/405* (2013.01)

(58) Field of Classification Search
USPC ..... 52/712, 655.1, 653.1, 668, 745.05, 696, 52/715; 403/231, 232.1; 248/247, 217.3, 248/220.1, 220.21
See application file for complete search history.

(56) References Cited

U.S. PATENT DOCUMENTS

| | | | | |
|---|---|---|---|---|
| 1,846,437 | A | 7/1989 | Fitzgerald | |
| 5,076,536 | A | 12/1991 | Fitzgerald | |
| 5,205,942 | A | 4/1993 | Fitzgerald | |
| 5,325,651 | A | 7/1994 | Meyer et al. | |
| 5,640,823 | A | 6/1997 | Bergeron et al. | |
| 5,720,571 | A * | 2/1998 | Frobosilo | E04B 2/96 403/2 |
| 5,846,018 | A * | 12/1998 | Frobosilo | E04B 2/96 403/2 |
| 5,906,080 | A | 5/1999 | diGirolamo et al. | |
| 6,213,679 | B1 * | 4/2001 | Frobosilo | E04B 2/82 403/14 |
| 6,230,467 | B1 | 5/2001 | Leek | |
| 6,247,677 | B1 | 6/2001 | Vinet et al. | |
| 6,418,694 | B1 | 7/2002 | Daudet et al. | |
| 6,430,890 | B1 | 8/2002 | Chiwhane et al. | |
| 6,609,344 | B2 * | 8/2003 | Saldana | E04B 1/2403 52/243 |
| 6,691,478 | B2 | 2/2004 | Daudet et al. | |
| 7,104,024 | B1 | 9/2006 | diGirolamo et al. | |
| 7,114,695 | B2 | 10/2006 | DeLoach, Sr. | |
| 7,216,465 | B2 | 5/2007 | Saldana | |
| 7,478,508 | B2 * | 1/2009 | Peterson | E04B 2/96 248/300 |
| 7,503,150 | B1 | 3/2009 | diGirolamo et al. | |
| D667,289 | S | 9/2012 | Preda | |
| 8,555,592 | B2 * | 10/2013 | Daudet | E04B 2/96 52/489.1 |
| 8,950,151 | B2 * | 2/2015 | Strickland | E04B 1/24 52/655.1 |
| D731,876 | S | 6/2015 | Di Stefano | |
| 2003/0093969 | A1 | 5/2003 | Saldana | |
| 2004/0020137 | A1 | 2/2004 | Battey et al. | |
| 2005/0072099 | A1 * | 4/2005 | Roesset | E04B 1/2608 52/633 |
| 2005/0229529 | A1 | 10/2005 | Frascari | |
| 2006/0096201 | A1 * | 5/2006 | Daudet | E04B 1/24 52/272 |
| 2006/0196143 | A1 | 9/2006 | Roesset et al. | |
| 2011/0219720 | A1 | 9/2011 | Strickland et al. | |
| 2012/0247059 | A1 | 10/2012 | Daudet et al. | |
| 2013/0000242 | A1 | 1/2013 | Ferguson et al. | |
| 2013/0125400 | A1 | 5/2013 | Clapp et al. | |
| 2014/0290175 | A1 | 10/2014 | Klein | |
| 2015/0184371 | A1 | 7/2015 | Stauffer et al. | |
| 2015/0275513 | A1 | 10/2015 | Feldpausch et al. | |

FOREIGN PATENT DOCUMENTS

| | | |
|---|---|---|
| GB | 2467039 | 7/2010 |
| JP | D1078434 | 7/2000 |
| JP | D1045701 | 12/2000 |
| JP | D1260864 | 1/2006 |
| JP | D1286467 | 11/2006 |
| JP | 2007032097 | 2/2007 |
| JP | D1299795 | 5/2007 |
| JP | D1491539 | 3/2014 |
| JP | D1530744 | 8/2015 |
| KR | 300779466 | 1/2015 |
| KR | 300790519 | 4/2015 |

OTHER PUBLICATIONS

Cold-Formed Structural Framing Products Technical Design Guide, ClarkDietrich Buiding Systems, 2012, 105 pages.
ClarkDietrich Product Information, May 2014, 1 page.
Trakloc(R) Drywall Framing System, ClarkDietrich Building Systems, http://www.clarkdietrich.com/products/drywall-framing/trackloc-drywall-framing-system, Jun. 2, 2017, 3 pages.
Trex Elevations(R) Steel Deck Framing with Transcend Decking in Tree House, Trex, http://www.trex.com/products/deck-framing-drainage/elevations/, Jun. 2, 2017, 22 pages.

* cited by examiner

SYSTEMS AND METHODS FOR BRACKET CONFIGURATIONS OF A FRAMING ASSEMBLY

CROSS REFERENCE TO RELATED APPLICATIONS

This is a non-provisional application that claims benefit to U.S. provisional application Ser. No. 62/403,936 filed on Oct. 4, 2016, and U.S. provisional application Ser. No. 62/454,378 filed on Feb. 3, 2017, which are herein incorporated by reference in their entirety.

FIELD

The present disclosure generally relates to systems and methods for interlocking brackets; and in particular, to systems and methods of manufacturing and configuring specialized interlocking brackets for a framing assembly.

BACKGROUND

Conventional framing assemblies and systems are complicated, burdensome, and difficult to deploy on-site and have consequently failed to satisfy the needs of users in the construction and general framing industries. For example, conventional framing assemblies often require structural connections to be made to an open side, external side, or outside portion of a joist or stud. Such connections may require additional connecting components or sleeves which can move the connecting point outside the edges of a connecting joist. One particular conventional framing assembly involves sleeves or tracks that attach to the outside of the joist and are implemented to connect adjacent joists. The attachment of tracks or sleeves on the outside of the joist creates an elevated component or surface which can be detected and can lead to framing complications. Additional tedious manufacturing steps may be involved when dealing with an elevated portion of a framing assembly which is time consuming and reduces the speed and efficiency of construction.

It is with these observations in mind, among others, that various aspects of the present disclosure were conceived and developed.

SUMMARY

A need exists for an improved framing assembly and methods of making the same. Accordingly, one embodiment of the present disclosure may take the form of a framing assembly comprising a bracket comprising a first bracket section in communication with a second bracket section with a bracket bend defined between the first bracket section and the second bracket section, the first bracket section aligned in perpendicular relation relative to the second bracket section along the bracket bend; a first slit and a second slit defined along the second bracket section, the first slit defined along a first lateral side of the second bracket section and the second slit defined along a second lateral side of the second bracket section opposite the first slit, the first slit defining a first width and a second width greater than the first width; and a plurality of linear sides defined along a periphery of the first bracket section, the plurality of linear sides including a first linear side extending orthogonally from the first lateral side of the second bracket section and a second linear side in communication with the first linear side at a corner of the first bracket section, the second linear side angled inwardly relative to the corner and oriented away from the first lateral side, wherein the bracket is configured to frictionally connect with a joist such that the first bracket section is aligned between opposing flanges of the joist and the first slit and the second slit of the bracket receive opposing returns of the joist.

Another embodiment of the present disclosure may take the form of a framing assembly, comprising: a bracket, comprising a first bracket section in communication with a second bracket section with a bracket bend defined between the first bracket section and the second bracket section, the first bracket section aligned in perpendicular relation relative to the second bracket section along the bracket bend; a first slit defined along a first lateral side of the second bracket section; and a second slit defined along a second lateral side of the second bracket section opposite the first slit, the first slit defining a tapered or triangular shape.

Another embodiment of the present disclosure may take the form of a method for interlocking components of a framing assembly, comprising: providing a first joist, the first joist including a web, a first flange defined along a first side of the web, a first return defined along the first flange, a second flange defined along a second side of the web opposite the first flange, and a second return defined along the second flange opposite the first return; providing a bracket, comprising a first bracket section in communication with a second bracket section with a bracket bend defined between the first bracket section and the second bracket section, the first bracket section aligned in perpendicular relation relative to the second bracket section along the bracket bend, a first slit defined along a first lateral side of the second bracket section, and a plurality of linear sides defined along a periphery of the first bracket section, the plurality of linear sides including a first linear side defined along the first lateral side of the bracket and extending orthogonally from the second bracket section and a second linear side in communication with the first linear side at a corner of the first bracket section, the second linear side angled inwardly relative to the corner and away from the first linear side; disposing the first bracket section over the web of the first joist between the first flange and the second flange of the first joist such that the second linear side is flush with the first flange and the corner is oriented at a first location along the first flange; rotating the bracket in a direction relative to the first joist to align the corner at a second location such that the corner is oriented towards the first flange; and applying a force in the direction to rotate the bracket such that the first linear side is aligned along the first flange and the corner is oriented in a third location along the first flange.

BRIEF DESCRIPTION OF THE DRAWINGS

The foregoing and other objects, features, and advantages of the present disclosure set forth herein should be apparent from the following description of particular embodiments of those inventive concepts, as illustrated in the accompanying drawings. Also, in the drawings the like reference characters refer to the same parts throughout the different views. The drawings depict only typical embodiments of the present disclosure and, therefore, are not to be considered limiting in scope.

Corresponding reference characters indicate corresponding elements among the view of the drawings. The headings used in the figures do not limit the scope of the claims.

DETAILED DESCRIPTION

Figure 1:
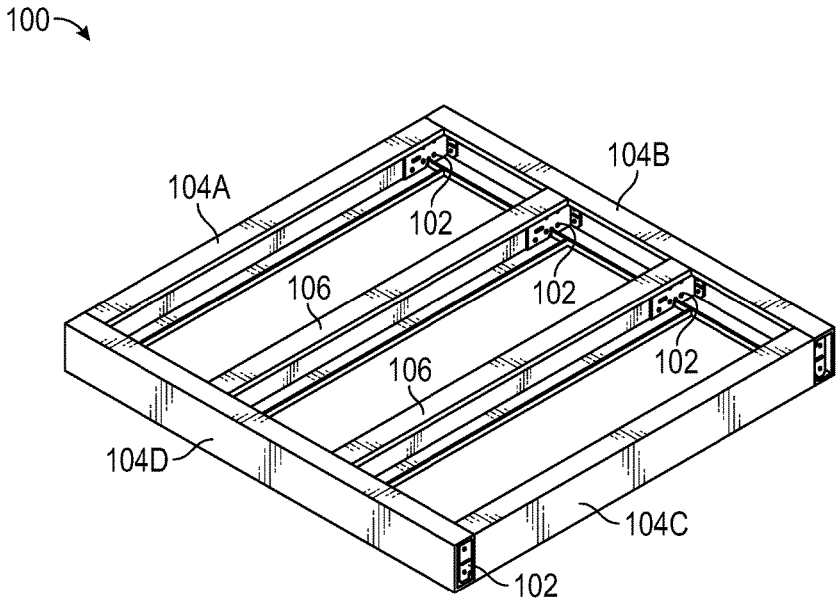
FIG. 1 is a perspective view of framing assembly comprising a plurality of brackets mechanically coupled to a plurality of joists, according to aspects of the present disclosure.

Aspects of the present disclosure relate to a framing assembly which may include a plurality of framing components such as brackets, joists, studs, end rails, side rails, interior sleeves, inserts, and the like. A bracket, in particular, may be implemented to interconnect adjacent components of the framing assembly. One embodiment of the bracket for use with the framing assembly may include a first bracket section in communication with a second bracket section. A bracket bend may be defined between the first bracket section and the second bracket section of the bracket such that the first bracket section is aligned in perpendicular relation relative to the second bracket section along the bracket bend. The bracket may include at least a first slit and a second slit defined along lateral sides of the second bracket section. The first slit and the second slit may be uniquely shaped to receive returns of e.g. a joist of the framing assembly, while providing a degree of friction to the returns when the bracket is coupled to the joist. The bracket may further include a plurality of linear sides and a plurality of corners defined along a periphery of the first bracket section. At least a portion of the linear sides may be angled with respect to one another to define the corners. When the bracket is coupled to the joist, the corners and linear sides of the bracket provide a degree of resistance to rotation of the bracket relative to portions of the joist, which temporarily holds the bracket in place against the joist and facilitates construction of the framing assembly as described herein.

In some embodiments, the slits, linear sides, and corners of the bracket collectively facilitate a snap-lock engagement of the bracket to a joist of the framing assembly, as described herein. A joist of the framing assembly may include a web or middle portion and flanges defined along opposite lateral sides of the web. The joist may further include returns defined along the flanges with the returns opposing one another such that the joist defines a C-shape configuration. The flanges, returns, and web of the joist may collectively define a joist interior portion which may be used to receive a portion of the bracket, as described herein.

To implement a snap-lock engagement of the bracket to the joist, the first bracket section may be oriented over the web within the joist interior portion between the flanges of the joist. Specifically, the first bracket section may be aligned in a first position within the joist interior portion such that a linear side of the first bracket section is flush with or abuts a first flange of the joist. The bracket may then be shifted to a second position by rotating the bracket relative to the joist in order to orient a corner of the first bracket section towards the first flange of the joist. In this second position, the corner may abut or otherwise contact a portion of the first flange to define a first contact point; and, an edge of the second bracket section on the opposite side of the bracket may abut or otherwise contact a portion of the second flange opposite the first flange to define a second contact point. The contact points provide resistance to additional rotation of the bracket relative to the joist, as described herein.

To align the bracket in a third position, an increase in rotational force may be exerted to further rotate the bracket and overcome the resistance at the first and second contact points. This increased rotational force may facilitate the first bracket section to snap in place within the joist interior portion as the corner clears the first contact point and the edge clears the second contact point to align the first bracket section over the web of the joist between the first and second flange. In this third position, the first bracket section is oriented along the web of the joist. In some embodiments, another joist may be engaged to the second bracket section of the bracket to continue construction of the framing assembly. In other embodiments, an interior sleeve or insert, which may define a shape similar to the joist, may be interposed between the bracket and the joist to tighten the connection between the joist and the bracket and otherwise facilitate the connection of the bracket to different sized components.

Contrary to conventional framing assemblies, the inventive brackets described herein may be implemented to mechanically connect components of the framing assembly from the interior side (within the joist interior portion). The brackets may temporarily interlock or otherwise hold the components in place using friction, which allows a builder to permanently secure the components together with reduced tools and effort leading to more efficient construction of the framing assembly. Referring to the drawings, embodiments for a framing assembly are illustrated and generally indicated as 100 in FIGS. 1-20.

Figure 2:
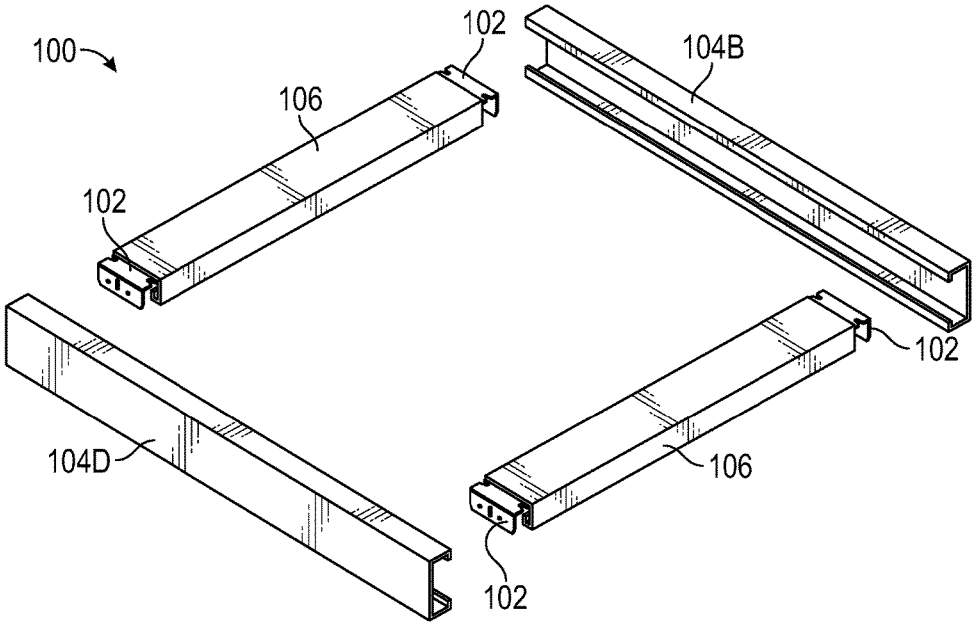
FIG. 2 is an exploded perspective view of the framing assembly of FIG. 1, according to aspects of the present disclosure.

Referring to FIGS. 1 and 2, a first embodiment of the framing assembly 100 may include one or more brackets 102 configured to be engaged and secured to one or more joists 104 and/or joists 106. In some embodiments, the framing assembly 100 may include one or more studs (not shown) defining a shape substantially similar or identical to the joists 104 and joists 106 with the studs extending in a vertical orientation as opposed to the horizontal orientation of the joists 104 and joists 106 shown. Studs may be implemented as vertically extending members of the framing assembly 100 to form e.g. vertical walls, and the joists 104 and joists 106 may comprise horizontal members implemented to form ceilings, roofs, decks, flooring, or any other such horizontal surface.

As shown, the joists 104 may include joists 104A, 104B, 104C, and 104D which may define respective sides of the framing assembly 100 and otherwise define a boundary or perimeter of the framing assembly 100. The joists 104A and 104C may define opposing end rails of the framing assembly, the joists 104B and 104D may define opposing side rails of the framing assembly 100, and the joists 106 may extend lengthwise in parallel orientation between the joist 104B and the joist 104D. The brackets 102 may be implemented to interlock or connect any of the joists 104 and 106 as described herein. The framing assembly 100 is not limited to the rectangular configuration shown and may define different shapes and orientations depending upon the particular application and framing components involved. Further, the framing assembly 100 is not limited to the aforementioned framing components disclosed and additional framing components are contemplated.

Figure 3:
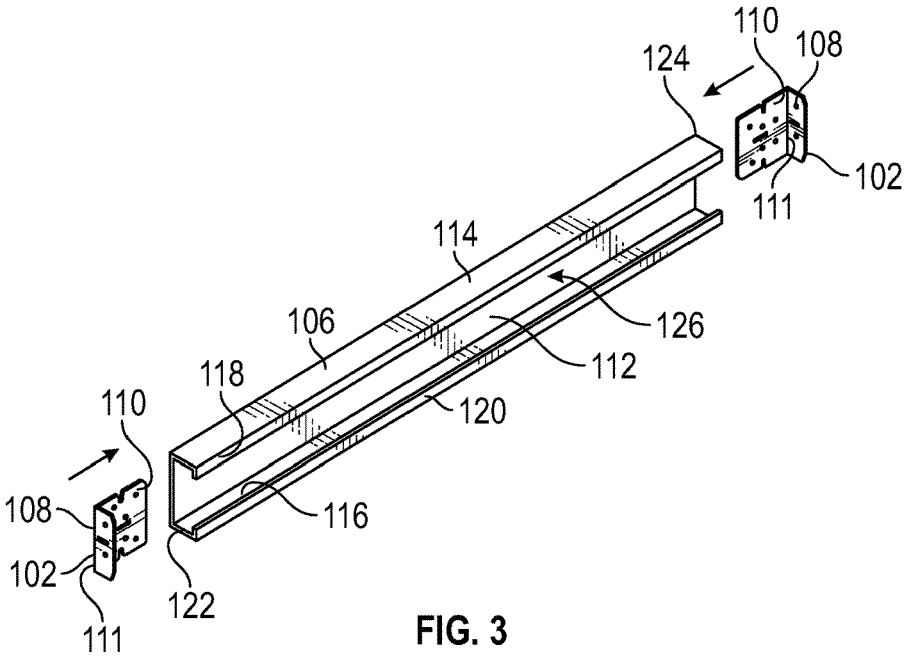
FIG. 3 is an exploded view of a portion of the framing assembly of FIG. 1 showing the brackets of FIG. 8 being engaged to opposite ends of a joist, according to aspects of the present disclosure.
Figure 4:
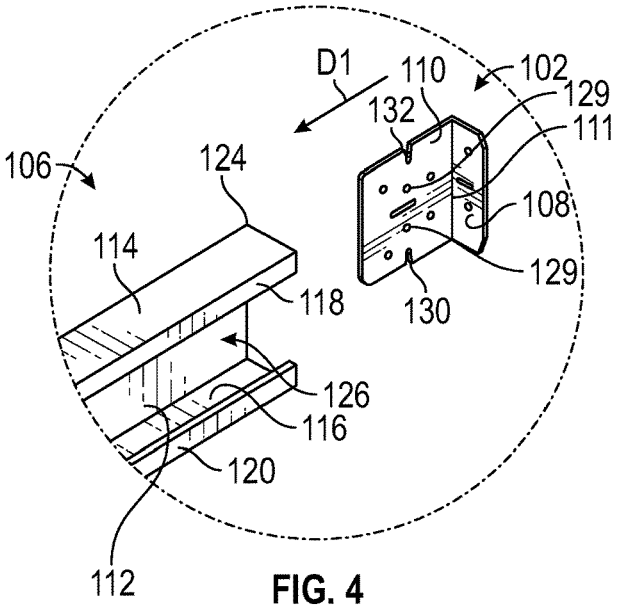
FIG. 4 is an enlarged view of one of the brackets of FIG. 3 illustrating one sequence for engaging the bracket to one end of a first joist, according to aspects of the present disclosure.
Figure 5:
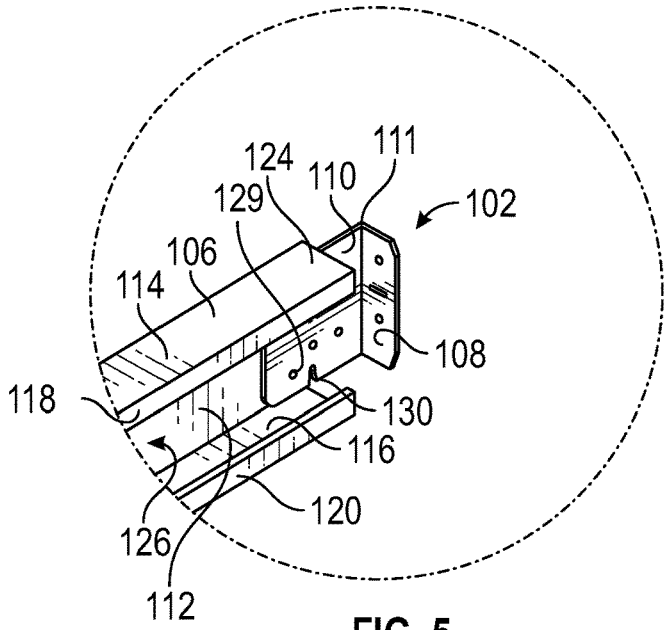
FIG. 5 is an enlarged view of the bracket of FIG. 4 illustrating the engagement of the bracket at one end of the first joist, according to aspects of the present disclosure.

Referring to FIGS. 3-5, the brackets 102 may be mechanically engaged, coupled, or otherwise connected to a joist 106 to form a portion of the framing assembly 100. As shown, the brackets 102 may generally define a first bracket section 108 and a second bracket section 110 in communication with the first bracket section 108 along a bracket bend 111. As shown in FIG. 4, the brackets 102 may further define a first slit 130 defined along a first side of the second bracket section 110 and a second slit 132 defined along a second side of the second bracket section 110 opposite the first slit 130. The joist 106 may include an elongated body defining a web 112 or middle portion, a flange 114 formed along a first side of the web 112, and a flange 116 formed along a second side of the web 112 opposite the flange 114. The joist 106 further comprises opposing returns 118 and 120 defined along the edges of the flanges 114 and 116 respectively. The returns 118 and 120 extend orthogonally from the edges of the flange 114 and the flange 116, respectively, such that the joist 106 defines a general C-shape configuration. The joist 106 further comprises a joist interior portion 126 defined collectively by the space between the web 112, the flanges 114 and 116, and the returns 118 and 120. The joist interior portion 126 generally defines a slot or cavity for receiving the second bracket section 110. In other words, the second bracket section 110 may be slidably inserted or positioned within the joist interior portion 126 of the joist 106 as indicated and described herein.

Referring to FIG. 3, in some embodiments, a pair of the brackets 102 may be partially engaged within the joist interior portion 126 at respective ends 122 and 124 of the joist 106 to form part of the framing assembly 100. To further illustrate for example, FIGS. 4-5 show the connection between a bracket 102 and an end 124 of the joist 106 by inserting the second bracket section 110 of the bracket 102 along a direction D1 to within the joist interior portion 126. The bracket 102 of FIG. 4 may be positioned as shown in FIGS. 4-5 such that the first slit 130 and the second slit 132 remain at least partially exposed or just outside a footprint of the joist interior portion 126 slightly away from the end 124 of the joist 106. As a result, the first and second slits 130 and 132 of the respective brackets 102 remain accessible for connection with other joists or different framing components, as described herein. In some embodiments, the bracket 102 of FIG. 4 may include one or more apertures 129 formed along the second bracket section 110 above the first and second slits 130 and 132; i.e., a predetermined distance from the bracket bend 111 along the second bracket section 110. The web 112 of the joist 106 may be visible through the apertures 129 such that the apertures 129 define locater holes that facilitate an ideal predetermined positioning of the bracket 102 within the joist interior portion 126 that leaves the slits 130 and 132 and the first bracket section 108 accessible for use. Specifically, due to the positioning of the apertures 129 as shown and described herein, a builder may terminate movement of the bracket 102 in the direction D1 once the surface area of the web 112 of the joist 106 becomes visible through the apertures 129 such that the first slit 130 and the second slit 132 remain at least partially exposed or just outside a footprint of the joist interior portion 126 away from the end 124 of the joist 106. In other embodiments, in place of or in combination with the apertures 129, the second bracket section 110 may comprise indentations, markers, or visual labels (not shown) formed in a location along the second bracket section 110 similar to the apertures 129 in order to facilitate an ideal predetermined positioning of the second bracket section 110 within the joist interior portion 126 of the joist 106. For example, the builder may align the end 124 of the joist 106 with one or more markers (not shown) formed along the second bracket section 110 in a location similar to the apertures 129.

As shown in FIG. 2 and FIG. 5, the first bracket sections 108 of the respective brackets 102 extend outwardly from the joist 106 such that the first bracket sections 108 also remain accessible for connection with other joists or framing components of the framing assembly 100, as described herein. As further shown, a portion of the second bracket sections 110 of the brackets 102 overlaps the web 112 of the joist 106. Accordingly, the brackets 102 connect to the joist 106 from the interior side; i.e., within the joist interior portion 126 of the joist 106 as opposed to an exterior side. This particular configuration, engaging the brackets 102, within the joist interior portion 126, reduces and/or eliminates the need for excess or an undesired amount of additional structure to be mounted to exterior surfaces of the joist 106 to connect the joist to the bracket 102, thereby improving upon conventional framing assemblies.

Figure 6:
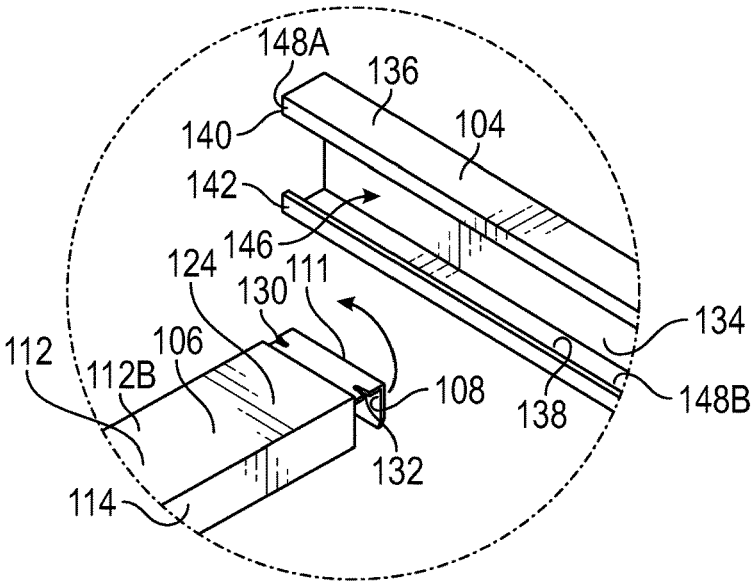
FIG. 6 is an enlarged view of the bracket of FIG. 4 illustrating one sequence for the engagement of the bracket to a second joist, according to aspects of the present disclosure.
Figure 7:
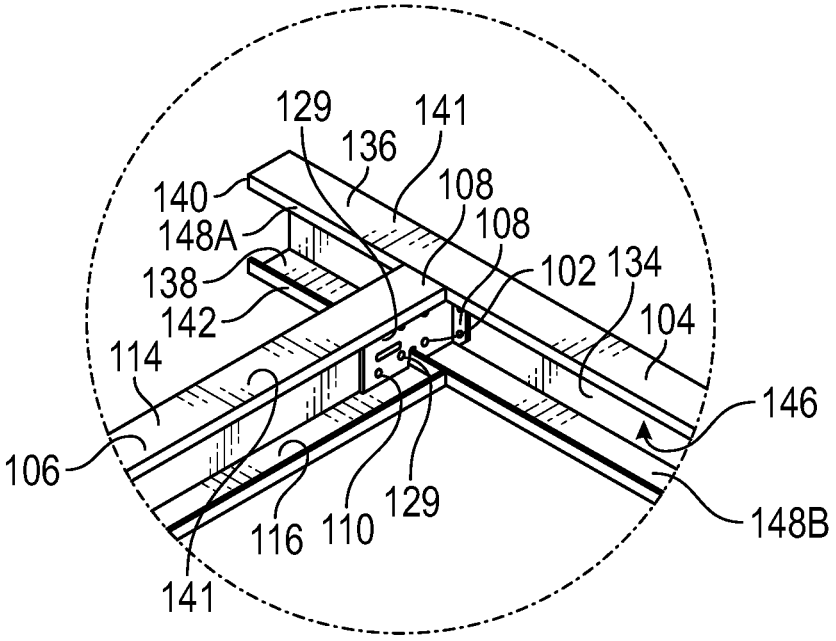
FIG. 7 is an enlarged view of the bracket of FIG. 4 illustrating the engagement of the bracket to a second joist, according to aspects of the present disclosure.

Referring to FIGS. 6-7, a joist 106, having a bracket 102 engaged at an end 124 of the joist 106 in a manner as described in FIGS. 3-5, may be engaged to a joist 104, such as the joist 104B of FIG. 1, to continue forming the framing assembly 100. The joist 104, similar or identical to the joist 106, may include a web 134, a flange 136 defined along a first side of the web 134, a flange 138 defined along a second side of the web 134 opposite the flange 136, a return 140 defined along the flange 136, and a return 142 defined along the flange 138 opposite the return 140. The web 134, flanges 136 and 138, and returns 140 and 142 of the joist 104 collectively define a joist interior portion 146 configured for receiving portions of the bracket 102 such as the first bracket section 108.

In some embodiments, the end 124 of the joist 106 of FIG. 6 may be positioned towards the web 134 of the joist 104 with an external surface 112B (FIG. 6) of the web 112 of the joist 106 oriented in an upwards position, and the first bracket section 108 oriented in a downwards position, as shown. The first bracket section 108 and the joist 106 may be inserted within the joist interior portion 146 of joist 104 and then rotated in the manner indicated to mechanically couple, snap-lock, connect, or otherwise engage the joist 106 to the joist 104, as further described herein. The first bracket section 108 may be positioned within the joist interior portion 146 anywhere along a length of the joist 104 between a first end 148A and a second end 148B of the joist 104.

As shown in FIG. 7, upon rotating and engaging the joist 106 to the joist 104 as shown, the flange 136 of the joist 104 is flush with the flange 114 of the joist 106. Likewise, the flange 116 of the joist 106 is flush with the flange 138 of the joist 104. As a result, for example, a top surface 141 is defined collectively by top/exterior surfaces (not shown) of the flange 136 and the flange 114. The top surface 141 may extend horizontally and may be flat, planar, and otherwise uninterrupted which is important for most builders. The top surface 141 may be suitable for mounting of a flooring component, a deck, or the like thereto and is otherwise readily usable; i.e., devoid of interrupting fastening components such as screws or elevated portions. This is in stark contrast to many conventional framing assemblies which are generally configured to connect a first joist and a second joist by forming the first joist with a slightly smaller profile than the second joist, and simply sliding the first joist within an interior portion of the second joist; and consequently, require overlap of the flanges associated with the first joist and second joist respectively. These conventional framing assemblies involve an overall height increase, interrupt the top plane between the first joist and the second joist, and may require screws, bolts, or other fastening components to be implemented along the top surface, further interrupting any conventional top surface. Conventional framing assemblies therefore lack the top surface 141 of FIG. 7 as described which may allow a builder to efficiently adjoin structure thereto without additional finishing steps such as the removal of screw heads or otherwise preparing the top surface 141 for e.g., the attachment of flooring beams, a deck, or the like. While FIGS. 6-7 illustrate engagement of the bracket 102 to the joist 104 after the second bracket section 110 of the bracket 102 is connected to the joist 106, engagement of the bracket 102 to the joist 104 may occur simultaneously with or before the bracket 102 is engaged to the joist 106, and the present disclosure is not limited in this regard.

Figure 8A:
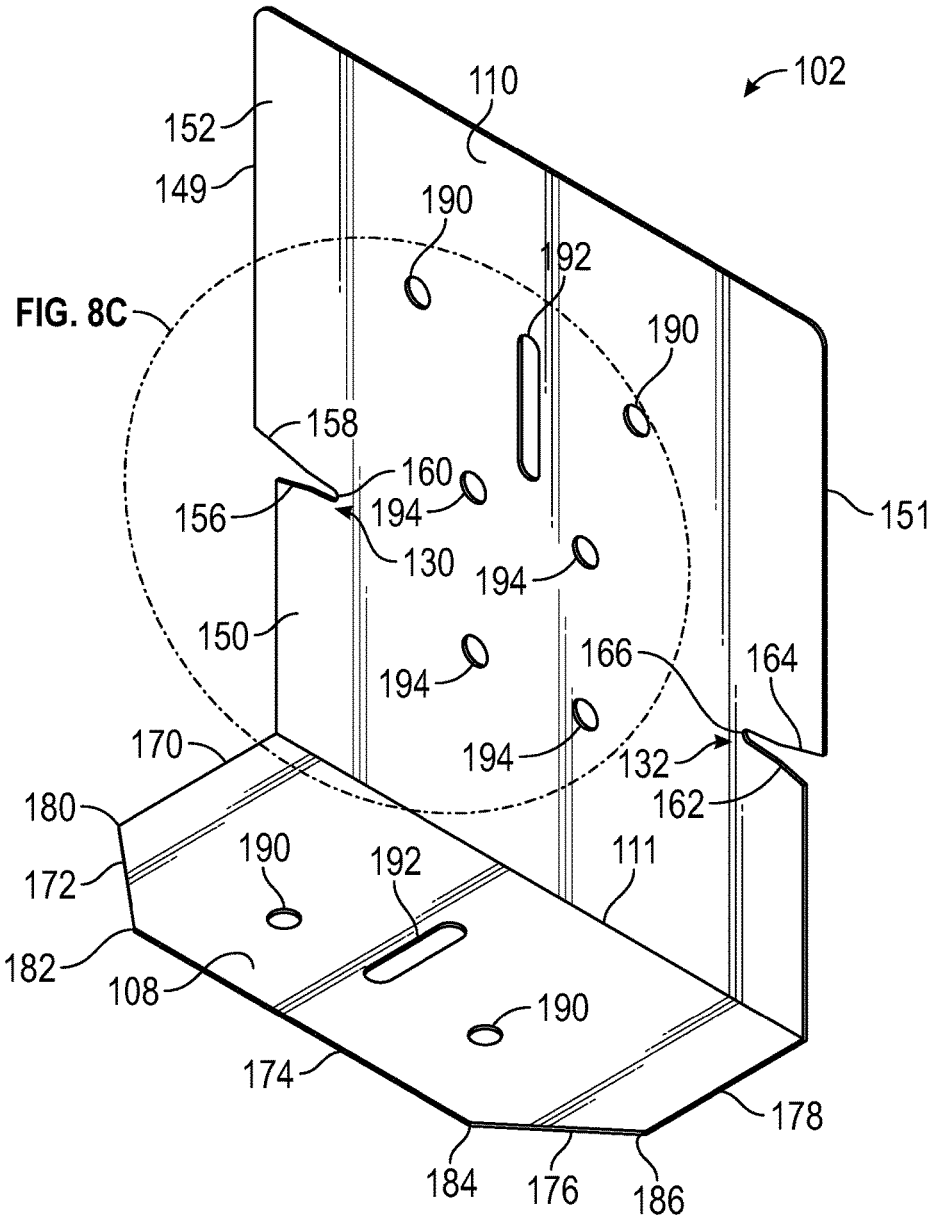
FIG. 8A is a perspective view of one embodiment of a bracket for use with the framing assembly described herein, according to aspects of the present disclosure.
Figure 8B:
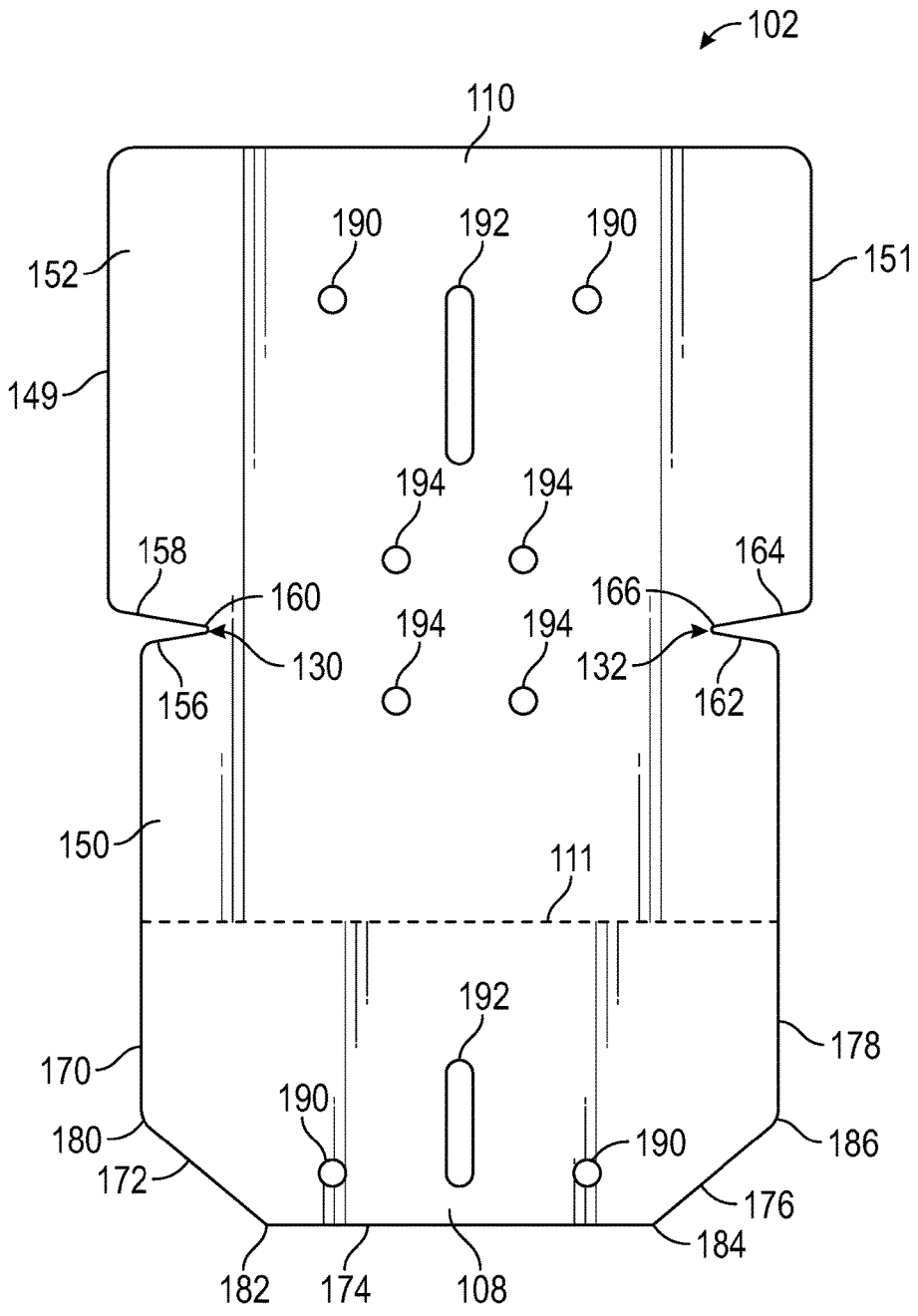
FIG. 8B is a plan view of the bracket of FIG. 8A for use with the framing assembly described herein, according to aspects of the present disclosure.
Figure 8C:
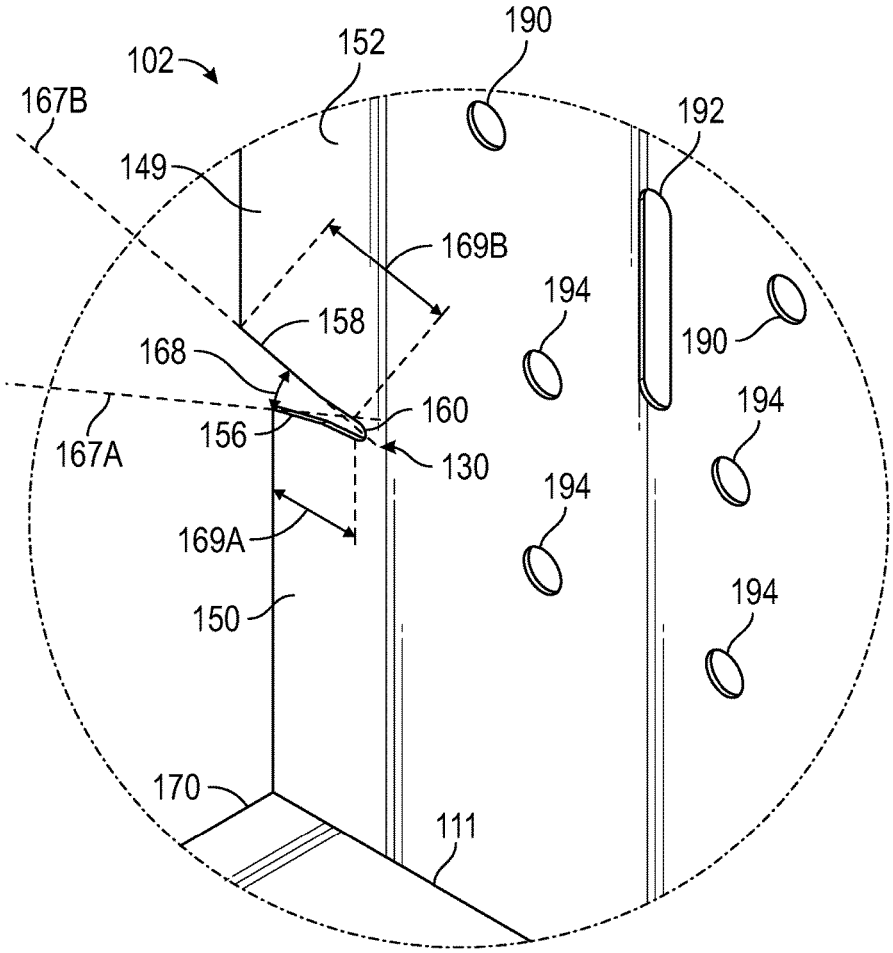
FIG. 8C is an enlarged view of a portion of the bracket of FIG. 8A, according to aspects of the present disclosure.

Referring to FIGS. 8A-8C, one embodiment of the bracket 102 is shown for connecting together the joists 104 and 106 of the framing assembly 100. The bracket 102 includes the first bracket section 108, and the bracket 102 includes the second bracket section 110 in communication with the first bracket section 108 along the bracket bend 111. In some embodiments, the first bracket section 108 is aligned in perpendicular relation relative to the second bracket section 110 along the bracket bend 111 such that the bracket 102 defines a general L-shaped configuration or 90 degree bracket. In some embodiments, the bracket bend 111 of the bracket 102, or more particularly, the orientation of the first bracket section 108 relative to the second bracket section 110 may vary such that the bracket 102 may define configurations other than a 90 degree bracket. For example, the orientation of the first bracket section 108 relative to the second bracket section 110 along the bracket bend 111 may be such that the bracket 102 may define a configuration in the range of 60-90 degrees, 30-60 degrees, 90 to 120 degrees, and 120 to 150 degrees, and the like. In other embodiments, the second bracket section 110 may be twisted relative to the first bracket section 108 to address different variations of the framing assembly 100.

As shown, the second bracket section 110 of the bracket 102 includes a first side 149, and a second side 151. Further, the second bracket section 110 may define a first portion 150 and a second portion 152 in communication with the first portion 150. The first portion 150 may be defined along the bracket bend 111 and the second portion 152 may be defined along the first portion 150 as shown. In some embodiments, the second portion 152 defines a width greater than a width of the first portion 150 of the second bracket section 110 which may be more suitable for engagement to a joist as described herein.

In some embodiments, the first slit 130 may be defined along the first side 149, and the second slit 132 may be defined along the second side 151 of the second bracket section 110. The first slit 130 and the second slit 132 may define a tapered or triangular shape, advantageous for receiving returns of a joist such as the returns 140 and 142 of the joist 104 as further described herein. More specifically, the first slit 130 may be formed or otherwise defined by a first sidewall 156 formed along one edge of the first portion 150 of the second bracket section 110, and a second sidewall 158 formed along an opposite edge of the second portion 152 of the second bracket section 110 opposite the first sidewall 156. The first sidewall 156 may be in communication with the second sidewall 158 at an interior point 160 defined within the first slit 130. In a similar manner, the second slit 132 may be formed or otherwise defined by a first sidewall 162 formed along an edge of the first portion 150 of the second bracket section 110, and a second sidewall 164 formed along an opposite edge of the second portion 152 of the second bracket section 110. The first sidewall 162 may be in communication with the second sidewall 164 at an interior point 166 defined within the second slit 132. As shown the first slit 130 and the second slit 132 may be aligned in parallel orientation relative to each other along the second bracket section 110.

Referring specifically to FIG. 8C, additional details regarding the first slit 130 are illustrated. As shown, the first sidewall 156 of the first slit 130 may substantially extend along a first axis 167A and the second sidewall 158 of the first slit 130 may substantially extend along a second axis 167B. The first axis 167A and the second axis 167B may substantially intersect at the interior point 160 of the first slit 130, to define an acute angle 168 which generally forms the tapered or triangular shape of the first slit 130 as illustrated. In addition, the first slit 130 may define a first width 169A along the first sidewall 156, and a second width 169B defined along the second sidewall 158. In some embodiments, the second width 169B is greater than the first width 169A of the first slit 130 by nature of the greater width of the second portion 152 of the second bracket section 110. In some embodiments, the first slit 130 may also be rounded along the interior point 160. It should be understood that the aforementioned features and dimensions of the first slit 130 may equally apply to the second slit 132 and additional slits may be formed within the bracket 102 as further described herein.

The first slit 130 and the second slit 132, formed with the tapered or triangular shape as shown and described herein, facilitate the engagement of the bracket 102 to the returns of a joist and can account for possible misalignment issues during construction. For example, during the formation of the framing assembly 100, it may be desired to couple a bracket 102, which may already be coupled to e.g. a side rail (and fixed in place), with a joist that is fixed in a particular position within the framing assembly 100; e.g., connected to another joist. Where the joist and bracket are fixed in place, or movement of the same is otherwise restricted, some misalignment may be presented between the returns of the joist and the first slit 130 and the second slit 132. Yet, because of the novel design described herein, with each of the first slit 130 and the second slit 132 having a wider opening and narrowing in size along an interior point, a builder can more easily pass the returns through the first slit 130 and the second slit 132, as the shape of the first slit 130 and the second slit 132 may function as a funnel to receive the returns despite some misalignment during engagement of the bracket to the joist.

As further shown FIGS. 8A and 8B, the first bracket section 108 of the bracket 102 includes a plurality of sides 170, 172, 174, 176 and 178 defined along a periphery of the first bracket section 108. In some embodiments, the plurality of sides 170, 172, 174, 176 and 178 includes a first side 170, a second side 172, a third side 174, a fourth side 176, and a fifth side 178. The plurality of sides 170, 172, 174, 176 and 178 may be contiguous, and each of the plurality of sides 170, 172, 174, 176 and 178 may be substantially linear or otherwise devoid of curvature as shown. The plurality of sides 170, 172, 174, 176 and 178 of the first bracket section 108 may define one or more corners along the first bracket section 108. Specifically as shown, the first side 170 and the second side 172 may define a first corner 180, the second side 172 and the third side 174 may define a second corner 182, the third side 174 and the fourth side 176 may define a third corner 184, and the fourth side 176 and the fifth side 178 may define a fourth corner 186.

In some embodiments, the orientation of the plurality of sides 170, 172, 174, 176 and 178 relative to one another may collectively define a pentagonal shape of the first bracket section 108. As shown, for example, the first side 170 may be defined along the first side 149 of the bracket 102 at a perpendicular angle relative to the first portion 150 of the second bracket section 110. The second side 172 may extend from the first side 170 and be angled inwardly relative to the first side 170 at the corner 180 such that the second side 172 is oriented away from the first side 149 of the second bracket section 110. The third side 174 may be in communication with the second side 172 and be oriented in parallel with the bracket bend 111. The fourth side 176 may be in communication with the third side 174 and be angled inwardly relative to the fifth side 178 at the corner 186, such that the fourth side 176 is oriented away from the second side 151 similar to the second side 172. The fifth side 178 may be defined along the second side of the bracket 102 at a perpendicular angle relative to the first portion 150 of the second bracket section 110.

In some embodiments, the second bracket section 110 may further include at least one opening 190 or slot 192 configured to receive a securing member (not shown), such as a screw or a bolt, to facilitate anchoring of the bracket 102 to components of the framing assembly 100, such as the joist 104. The at least one opening 190 or slot 192 may be formed on the bracket 102 in different locations and may vary with respect to size and opening. As described herein, the novel features and dimensions of the bracket 102 facilitates a snap-engagement or otherwise forms a part of a temporary holding mechanism as the first bracket section 108 of the bracket 102 is positioned within the joist interior portion 146 of the joist 104, which frees up hands of a builder to secure the bracket 102 more permanently to other framing components using the at least one opening 190 or slot 192.

In some embodiments, the bracket 102 may include one or more apertures 194, identical to or similar to the apertures 129 formed on the second bracket section 110. A first set of the apertures 194 may be formed along the first portion 150 just below the first and second slits 130 and 132 and above the bracket bend 111, and a second set of the apertures 194 may be formed above the first and second slits 130 and 132 along the second portion 152 as shown. However, in other embodiments, additional apertures may be formed, or the bracket 102 may be limited to either of the first set of the apertures 194 or the second set of the apertures 194 described. As indicated and described in FIGS. 4-5, for example, the web 112 of the joist 106 may be visible through the apertures 194 such that the apertures 194 define locater holes that facilitate an ideal predetermined positioning of the bracket 102 within the joist interior portion 126 that leaves the slits 130 and 132 and the first bracket section 108 accessible for use. As such, a builder may terminate movement of the bracket 102 within the joist interior portion 126 when the surface area of the web 112 of the joist 106 becomes visible through the apertures 194 such that the first slit 130 and the second slit 132 remain at least partially exposed or just outside a footprint of the joist interior portion 126 away from the end 124 of the joist 106. In other embodiments, in place of or in combination with the apertures 194, the second bracket section 110 may comprise indentations, markers, or visual labels (not shown) formed in a location along the second bracket section 110 similar to the apertures 194 in order to facilitate an ideal predetermined positioning of the second bracket section 110 within the joist interior portion 126 of the joist 106. For example, the builder may align the end 124 of the joist 106 with one or more markers formed along the second bracket section 110 adjacent the first and second slits 130 and 132 (not shown). This may facilitate a connection between the bracket 102 and the joist 106 such that the first bracket section 108 as well as the first slit 130 and the second slit 132 remain accessible for connection with other framing components of the framing assembly 100.

In some embodiments, the first bracket section 108 may be entirely planar, and/or the second bracket section 110 may be entirely planar, such that the first bracket section 108 and the second bracket section 110 are both devoid of additional structure other than the features described herein. In some embodiments, the first bracket section 108 may be substantially planar, and/or the second bracket section 110 may be substantially planar and may include ribs, reinforcing bends, or the like. As a result, the bracket 102 is versatile and suitable for use in a wide variety of applications. The bracket 102 further requires less manufacturing costs, while implementation of the bracket 102 increases construction efficiency as the brackets 102 may be used to adjoin or connect various components of the framing assembly 100 and hold them in place temporarily by way of friction between portions of the bracket 102 and a joist 104; freeing up hands of a builder until permanent securing members such as screws, bolts, or the like can be applied.

Figure 9:
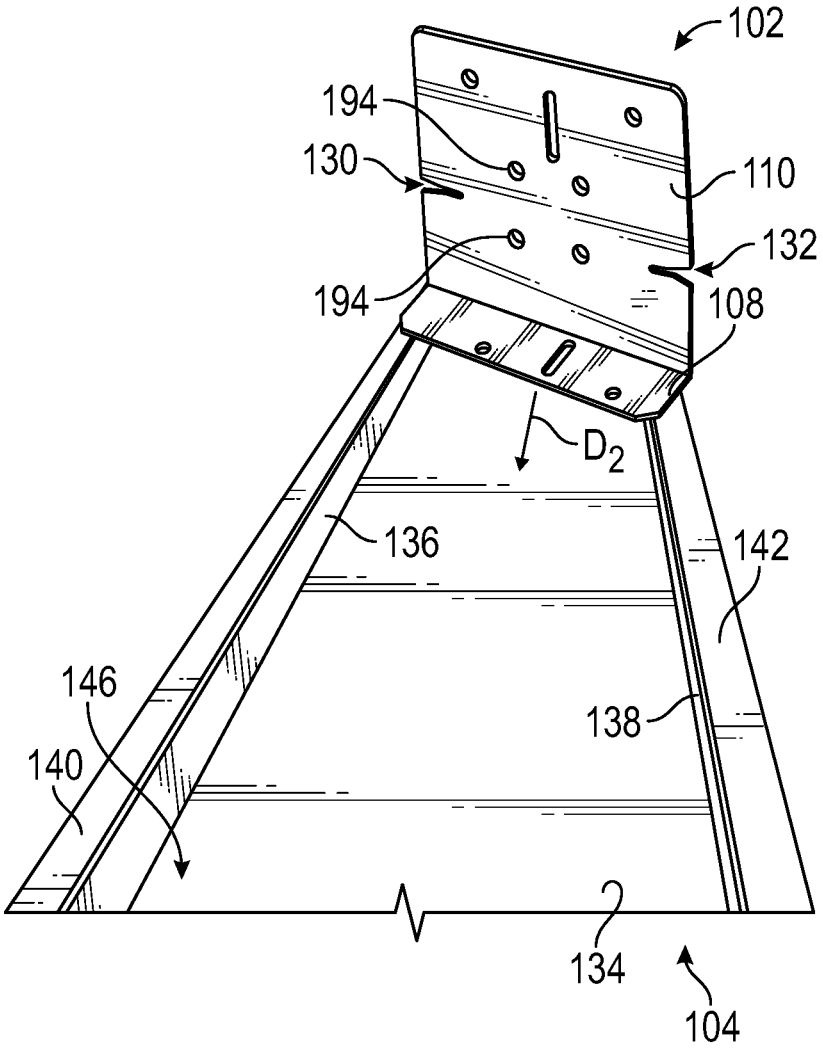
FIG. 9 is a perspective view of a first sequence for mechanically coupling the bracket of FIG. 8A to a joist, according to aspects of the present disclosure.

FIGS. 9-12 provide further detail regarding the snap-lock engagement of FIGS. 6-7 relating to the connection of the first bracket section 108 of the bracket 102 to a joist, such as any one of the joists 104. In FIG. 9, the first bracket section 108 of the bracket 102 may be oriented over the web 134 of a joist 104, and then brought in a direction D2 as indicated to position the first bracket section 108 within the joist interior portion 146. In some embodiments as shown, the bracket 102 may be oriented at an angle relative to the joist 104 to facilitate the passage of the first bracket section 108 between the flanges 136 and 138 and the returns 140 and 142 of the joist 104 to within the joist interior portion 146. The first bracket section 108 may further include a width slightly smaller than a width or distance between the flanges 136 and 138 of the joist 104.

Figure 10:
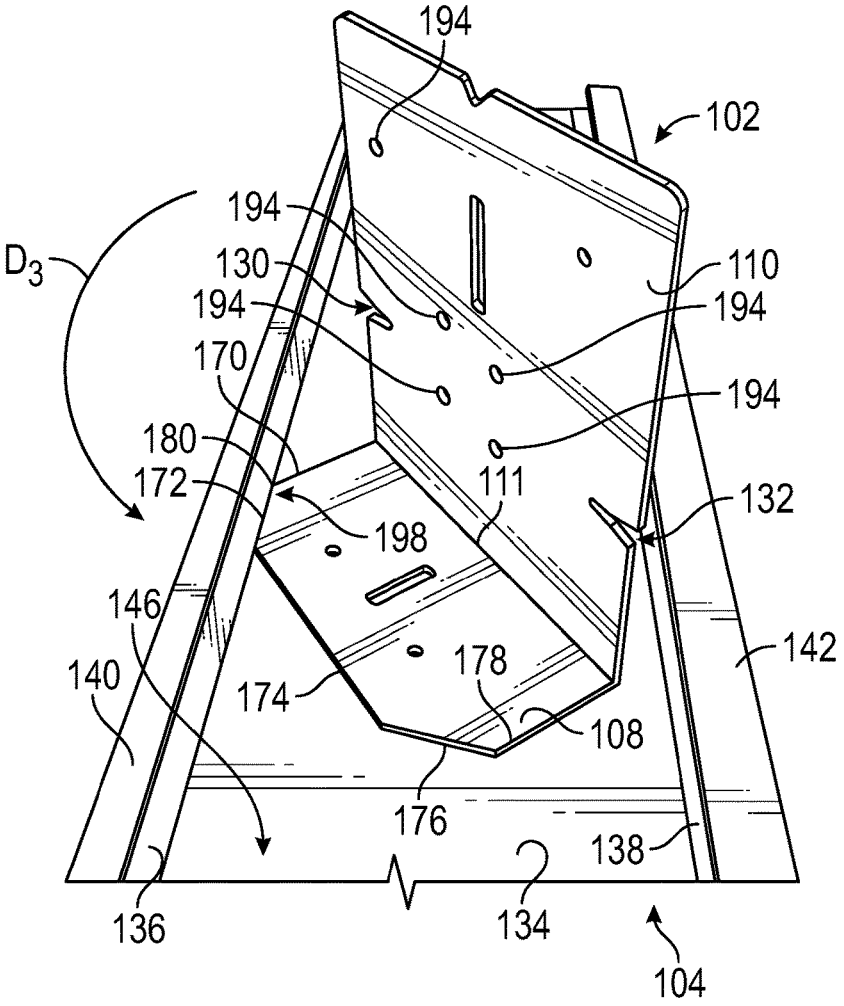
FIG. 10 is a perspective view of a second sequence for mechanically coupling the bracket of FIG. 8A to a joist, according to aspects of the present disclosure.

Referring to FIG. 10, in some embodiments, the first bracket section 108 may be moved to a first position within the joist interior portion 146 such that the second side 172 of the first bracket section 108 is flush along and abuts the flange 136 as shown. In this first position, the corner 180 of the first bracket section 108 may be oriented to a first location 198 along the flange 136. As further shown, the first bracket section 108 may then be twisted, turned, or otherwise rotated in the direction D3 (counter-clockwise) within the joist interior portion 146 to a second position.

Figure 11A:
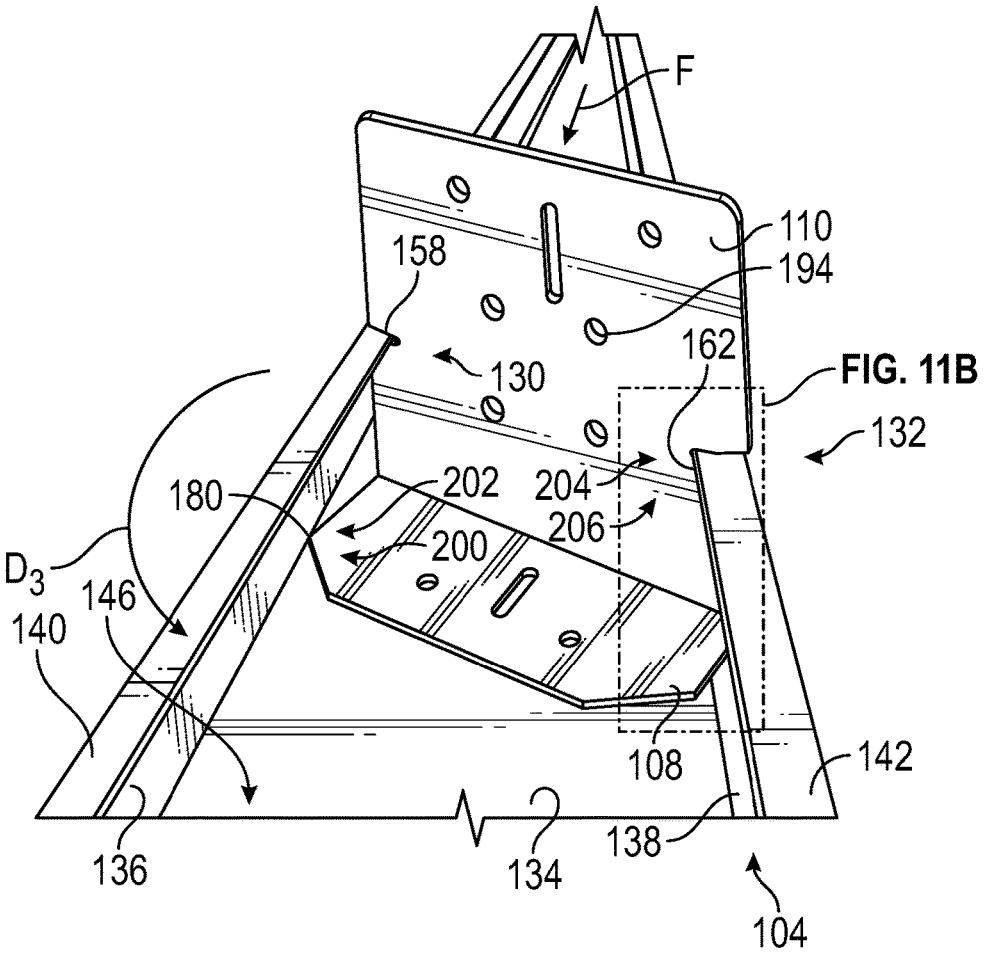
FIG. 11A is a perspective view of a third sequence for mechanically coupling the bracket of FIG. 8A to a joist, according to aspects of the present disclosure.
Figure 11B:
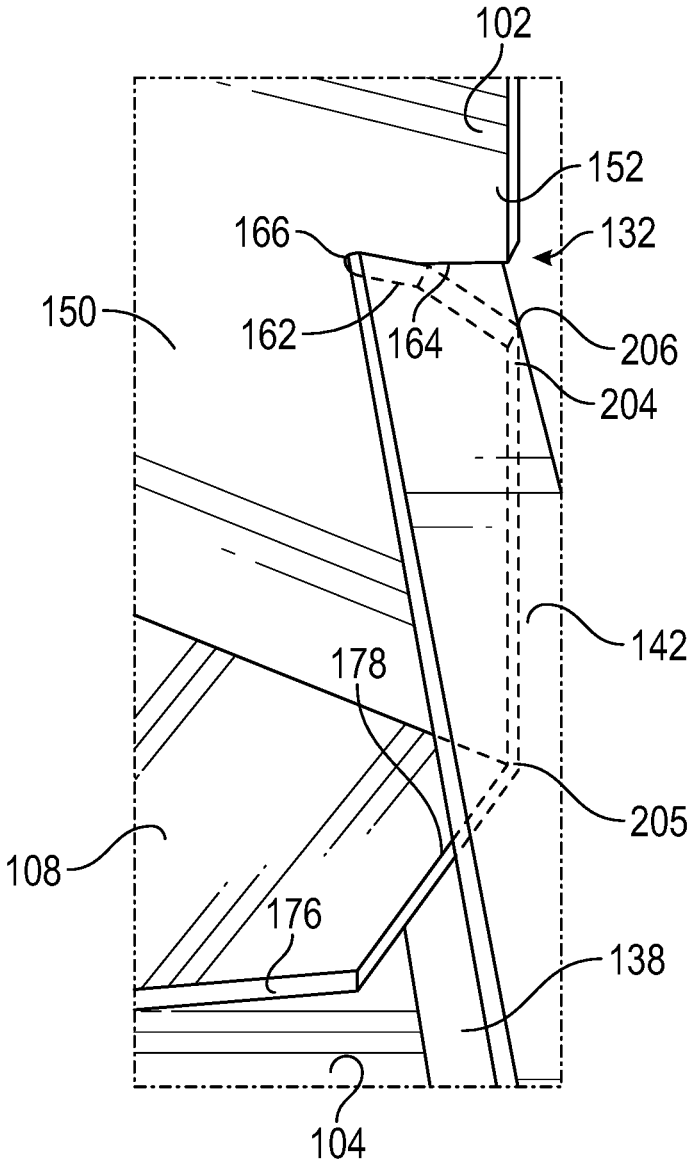
FIG. 11B is an enlarged view associated with the third sequence of FIG. 11A for mechanically coupling the bracket of FIG. 8A to a joist, according to aspects of the present disclosure.

Referring to FIGS. 11A-11B, upon rotation of the first bracket section 108 within the joist interior portion 146 as indicated in FIG. 10, the corner 180 of the first bracket section 108 is shifted to a second location 200 such that the corner is oriented towards and abuts the flange 136. In some embodiments, the corner 180 directly contacts the flange 136 at a contact point 202. In addition, the flange 138 and the return 142 may contact the first sidewall 162 of the second slit 132 at an edge 204 of the second bracket section 110. The edge 204 may be defined as indicated adjacent the first sidewall 162. In other embodiments, the edge may be defined anywhere along the first sidewall 162. In some embodiments, a contact point 206 is defined where the edge 204 of the first sidewall 162 contacts portions of the return 142 and flange 138 as indicated. In some embodiments, depending upon the dimensions of the bracket 102 and the joist 104, the contact point 206 may be defined anywhere along a length of the first sidewall 162 and/or the second sidewall 164 or along a side edge of the second bracket section 110 below or adjacent the first sidewall 162.

The contact point 202 and the contact point 206 provide resistance to continued rotation in the direction D3 by the bracket 102. In other embodiments as indicated, an additional contact point 205 may be defined between the flange 138, and an intersection between the second bracket section 110 and the fifth side 178 of the first bracket section 108, which may provide some resistance to rotation similar to the contact points 202 and 206.

As shown in FIG. 11A, a force designated F may be applied to the bracket 102 to continue rotation of the first bracket section 108 in the direction D3 within the joist interior portion 146. The force F assists to overcome the resistance at contact points 202, 205, and 206 in order to rotate the first bracket section beyond contact the points 202, 205, and 206, thereby snapping the first bracket section 108 of the bracket 102 in place within the joist interior portion 146 to a third position shown in FIG. 12.

Figure 12:
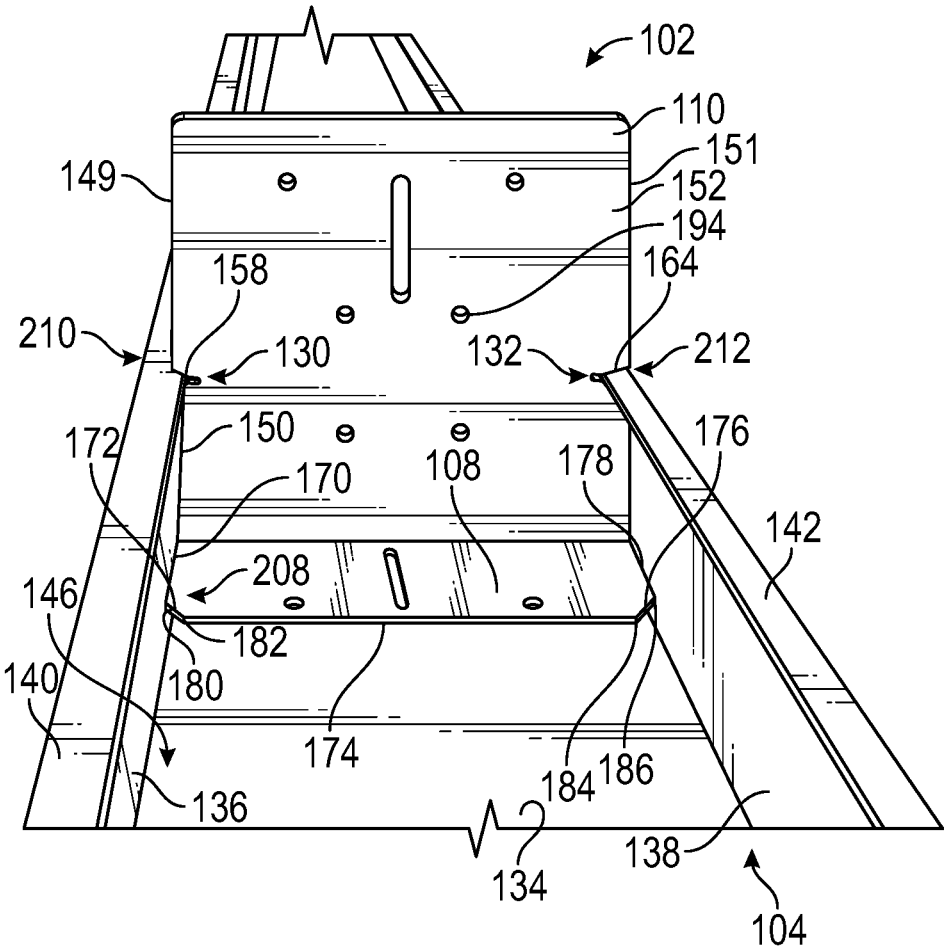
FIG. 12 is a perspective view of the bracket of FIG. 8A mechanically coupled to a joist, according to aspects of the present disclosure.

Referring to FIG. 12, the bracket 102 is brought to the third position such that the second bracket section 110 is in perpendicular relation relative the web 134 of the joist 104, the first side 170 of the first bracket section 108 is aligned along the flange 136, and the fifth side 178 is aligned along the flange 138 of the joist 104. In addition the first slit 130 receives the return 140, and the second slit 132 receives the return 142. As shown, the corner 180 is oriented at location 208 relative to the flange 136, different than the location 198 and the location 200. The second portion 152 of the second bracket section 110 at least partially overlaps the return 140 and the return 142 of the joist 104. By virtue of the dimensions of the first and second slits 130 and 132 described herein, the second portion 152 of the second bracket section 110 overlaps the return 140 and the return 142 with a gap 210 defined between the return 140 of the joist 104 and the second sidewall 158 of the first slit 130, while a gap 212 is defined between the second sidewall 164 of the second slit 132 and the return 142 of the joist 104. In some embodiments, the gap 210 and the gap 212 may be reduced or eliminated where, e.g., the returns 140 and 142 of the joist 104 vary in dimensions, and/or due to some misalignment between the bracket 102 and the joist 104.

In some embodiments, the first portion 150 of the second bracket section 110 may be sized to a width less than a width between the flange 136 and the flange 138 of the joist 104. Further, the bracket 102 may be sized such that once the bracket 102 is engaged to the joist 104 in the third position of FIG. 12, with the corner 180 being aligned along the flange 136 and the opposite corner 186 being aligned along the flange 138 of the joist 104 as shown, the corner 180 and the corner 186 restrict movement of the first bracket section 108 within the joist interior portion 146. As such, further rotational movement of the bracket 102 is restricted by the first bracket section 108 unless an additional or increased force is exerted further in the direction D3 or in an opposite rotational direction. Consequently, the features and dimensions of the bracket 102 relative to the joist 104 define a temporary holding mechanism of the first bracket section 108 within the joist interior portion 146. Upon assuming the third position of FIG. 12, the bracket 102 and the joist 104 may be fastened together more permanently using bolts, screws, or the like (not shown) which may be engaged through any one or more of the openings 190 or slots 192 of the bracket 102. In other embodiments, the bracket 102 may be mounted to the joist 104 using self-drilling screws which may eliminate or at least reduce the implementation of openings 190 or slots 192.

It should be understood that the bracket 102 may be engaged to the joist 104 in a manner similar to FIGS. 9-12 using a different corner and rotating the bracket 102 in a direction opposite of the direction D3. For example, in one embodiment (not shown), the first bracket section 108 may be positioned within the joist interior portion 146 such that the fourth side 176 is aligned along the flange 138 similar to but mirroring the position of the bracket 102 shown in FIG. 10. The bracket 102 may then be rotated further clockwise to orient the corner 186 towards the flange 138, and then a force may be applied to snap the corner 186 beyond the flange 138 in the clockwise direction to connect the bracket 102 to the joist 104 in a position similar to the position illustrated in FIG. 12.

In some embodiments, the first bracket section 108 may be formed with a predetermined length corresponding to a predetermined desired degree of rotational resistance. Specifically, e.g., the first side 170 and the fifth side 178 may be lengthened to increase a hypotenuse of the triangle across the rectangle made at the first bracket section 108. In this manner, the corner 180 and the corner 186 may be positioned farther away from the bracket bend 111. An increased length of the first bracket section 108 as described may increase possible contact interference of the first bracket section 108 with the inside surfaces of the web 134, the flange 136, and the flange 138 which may define additional contact points or otherwise increase resistance to rotation of the bracket 102 within the joist interior portion 146 and further maintain the bracket 102 in place relative to the joist 104. As such, the first side 170 and the fifth side 178 of the first bracket section 108 may be manufactured with a greater length in cases where additional rotational resistance within the joist interior portion 146 is desired. In addition, the various dimensions of the bracket 102 may vary to accommodate different sized joists.

Figure 13A:
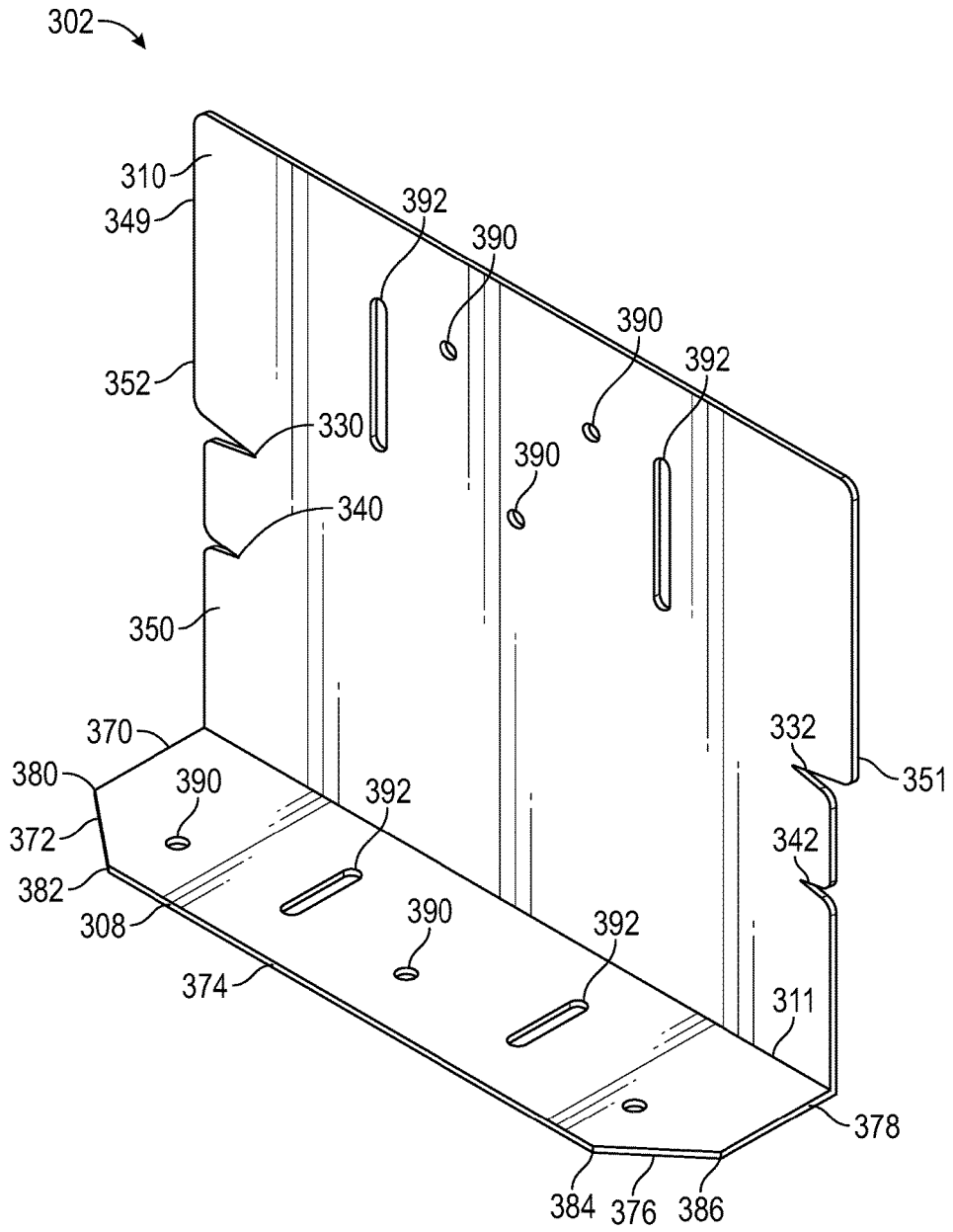
FIG. 13A is a perspective view of a second embodiment of a bracket for use with the framing assembly of FIG. 1, according to aspects of the present disclosure.
Figure 13B:
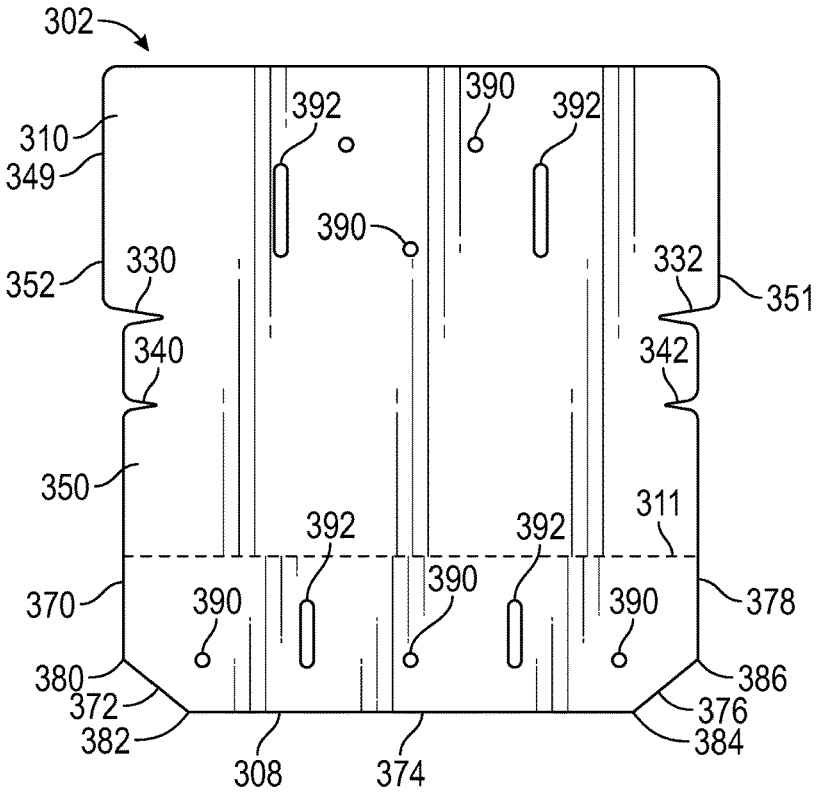
FIG. 13B is a plan view of the bracket of FIG. 13A, according to aspects of the present disclosure.

Referring to FIGS. 13A-13B, a second embodiment of a bracket, designated 302, for interconnecting components of the framing assembly 100 is illustrated. The bracket 302 defines a first bracket section 308, and second bracket section 310 in communication with the first bracket section 308 along a bracket bend 311. In some embodiments, the first bracket section 308 is aligned in perpendicular relation relative to the second bracket section 310 along the bracket bend 311 such that the bracket 302 defines a general L-shaped configuration or 90 degree bracket. As shown, the second bracket section 310 of the bracket 302 includes a first side 349, and an opposite second side 351. Further, the second bracket section 310 may define a first portion 350 and a second portion 352 in communication with the first portion 350. In some embodiments, the second portion 352 of the second bracket section 310 defines a width greater than a width of the first portion 350 of the second bracket section 310.

In some embodiments, the bracket defines a first slit 330 along the first side 349 of the second bracket section 310, and a second slit 332 along the second side 351 of the second bracket section 310 as shown. The first slit 330 and the second slit 332 may define a tapered or triangular shape similar to the first slit 130 and the second slit 132 of the bracket 102. As shown, the first slit 330 and the second slit 332 may be aligned in parallel orientation along the second bracket section 310.

The bracket 302 further includes a third slit 340 defined along the first portion 350 of the second bracket section 310 proximate the first slit 330 and a fourth slit 342 defined along an opposite side of the first portion 350 of the second bracket section 310 proximate the second slit 332. In some embodiments the third slit 340 and the fourth slit 342 may define a shape similar to the first slit 330 and the second slit 332. In some embodiments the third slit 340 and the fourth slit 342 may be aligned in parallel along opposite sides of the second bracket section 310. Utilizing two or more pairs of slits, i.e., forming the first and second slits 330 and 332, and forming the third and fourth slit 340 and 342 as shown, the bracket 302 is suitable for different sized joists of the framing assembly 100; e.g. joists with different profiles and/or different sized webs, flanges, and/or returns.

As further shown, the first bracket section 308 of the bracket 302 includes a plurality of sides 370, 372, 374, 376 and 378 defined along a periphery of the first bracket section 308 similar to the bracket 102. The plurality of sides 370, 372, 374, 376 and 378 may be contiguous, and each of the plurality of sides 370, 372, 374, 376 and 378 may be substantially linear or otherwise devoid of curvature as shown. The plurality of sides 370, 372, 374, 376 and 378 of the first bracket section 308 may define a plurality of corners 380, 382, 384 and 386 along the first bracket section 308 as shown. In some embodiments, the orientation of the plurality of sides 370, 372, 374, 376 and 378 relative to one another may collectively define a pentagonal shape of the first bracket section 308. In some embodiments, the second bracket section 310 may further include at least one aperture 390 or slot 392 configured to receive a securing member (not shown) such as a screw or a bolt to facilitate anchoring of the bracket 302 to components of the framing assembly 100, such as the joist 104.

Utilizing an attachment sequence similar to FIGS. 9-12, the bracket 302 is configured for snap-engagement to a joist utilizing the novel arrangement of the first bracket section 308 with the plurality of corners 380, 382, 384 and 386 and the slits 330 and 332, which frees up hands of a builder to secure the bracket 302 more permanently to other framing components. In some embodiments, the bracket 302 further includes one or more apertures (not shown) similar to the apertures 129 of the bracket 102 to guide the second bracket section 310 to a predetermined position within a joist interior portion.

Figure 14:
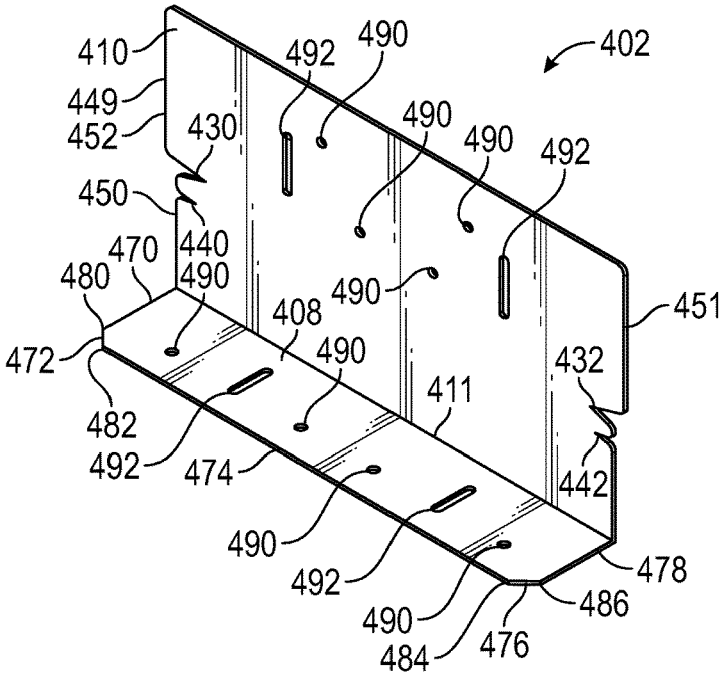
FIG. 14 is a perspective view of a third embodiment of a bracket for use with the framing assembly of FIG. 1, according to aspects of the present disclosure.

Referring to FIG. 14, a third embodiment of a bracket, designated 402, for interconnecting components of the framing assembly 100 is illustrated. The bracket 402 defines a first bracket section 408, and second bracket section 410 in communication with the first bracket section 408 along a bracket bend 411. In some embodiments, the first bracket section 408 is aligned in perpendicular relation relative to the second bracket section 410 along the bracket bend 411 such that the bracket 402 defines a general L-shaped configuration or 90 degree bracket. As shown, the second bracket section 410 of the bracket 402 includes a first side 449, and an opposite second side 451. Further, the second bracket section 410 may define a first portion 450 of the second bracket section 410 a second portion 452. In some embodiments, the second portion 452 of the second bracket section 410 defines a width greater than a width of the first portion 450 of the second bracket section 410.

In some embodiments, the bracket defines a first slit 430 along the first side 449 of the second bracket section 410, and a second slit 432 along the second side 451 of the second bracket section 410 as shown. The first slit 430 and the second slit 432 may define a tapered or triangular shape similar to the first slit 130 and the second slit 132 of the bracket 102. As shown, the first slit 430 and the second slit 432 may be aligned in parallel orientation along opposite sides of the second bracket section 410.

In some embodiments, the bracket 402 includes a third slit 440 defined along the first portion 450 of the second bracket section 410 and a fourth slit 442 defined along an opposite side of the first portion 450 of the second bracket section 410. The third slit 440 and the fourth slit 442 may define a shape similar to the first slit 430 and the second slit 432. The third slit 440 and the fourth slit 442 may be aligned in parallel along the second bracket section 410. Utilizing two or more pair of slits, i.e., forming the first and second slits 430 and 432, and forming the third and fourth slit 440 and 442 as shown, the bracket 402 is suitable for accommodating different sized joists of the framing assembly 100. The bracket 402 differs from the bracket 302 by defining a more elongated shape suitable for a wider joist.

As further shown, the first bracket section 408 of the bracket 402 includes a plurality of sides 470, 472, 474, 476 and 478 defined along a periphery of the first bracket section 408 similar to the bracket 102. The plurality of sides 470, 472, 474, 476 and 478 may be contiguous, and each of the plurality of sides 470, 472, 474, 476 and 478 may be substantially linear or otherwise devoid of curvature as shown. The plurality of sides 470, 472, 474, 476 and 478 of the first bracket section 408 may define a plurality of corners 480, 482, 484 and 486 along the first bracket section 408 as shown. In some embodiments, the orientation of the plurality of sides 470, 472, 474, 476 and 478 relative to one another may collectively define a pentagonal shape of the first bracket section 408. In some embodiments, the second bracket section 410 may further include at least one aperture 490 or slot 492 configured to receive a securing member (not shown) such as a screw or a bolt to facilitate anchoring of the bracket 402 to components of the framing assembly 100, such as the joist 104.

Utilizing an attachment sequence similar to FIGS. 9-12, the bracket 402 is configured for snap-engagement to a joist 104 utilizing the novel arrangement of the first bracket section 408 with the plurality of corners 480, 482, 484 and 486 and the slits 430 and 432, which frees up hands of a builder to secure the bracket 402 more permanently to other framing components. In some embodiments, the bracket 402 further includes one or more apertures (not shown) similar to the apertures 129 of the bracket 102 to guide the second bracket section 410 to a predetermined position within a joist interior portion.

Figure 15:
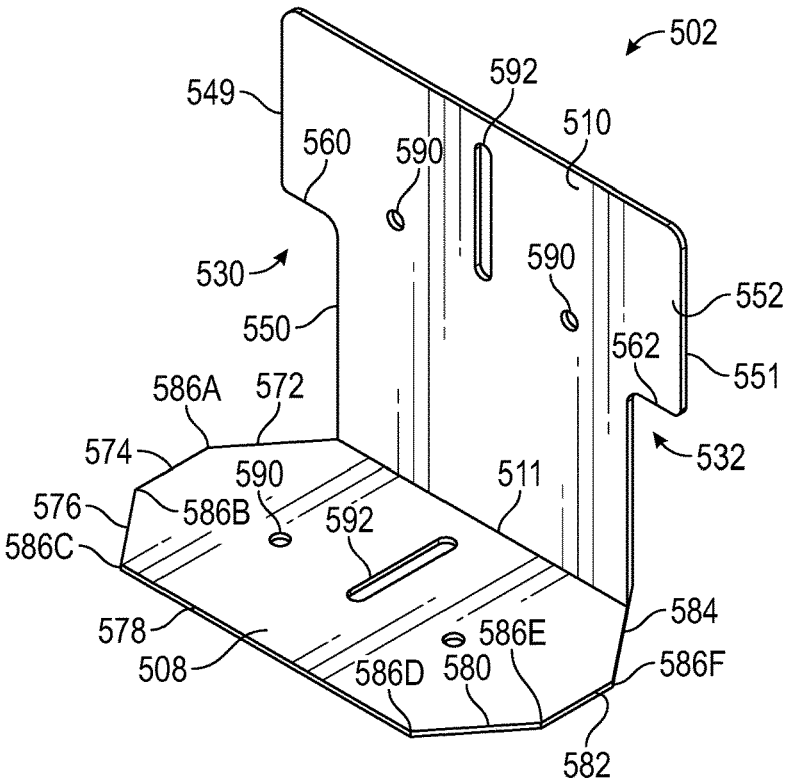
FIG. 15 is a perspective view of a fourth embodiment of a bracket for use with the framing assembly of FIG. 1, according to aspects of the present disclosure.

Referring to FIG. 15, another embodiment of a bracket, designated 502, for interconnecting components of the framing assembly 100 is illustrated. The bracket 502 defines a first bracket section 508, and second bracket section 510 in communication with the first bracket section 508 along a bracket bend 511. In some embodiments, the first bracket section 508 is aligned in perpendicular relation relative to the second bracket section 510 along the bracket bend 511 such that the bracket 502 defines a general L-shaped configuration or 90 degree bracket. As shown, the second bracket section 510 of the bracket 502 includes a first side 549 and a second side 551. Further, the second bracket section 510 may define a first portion 550 and a second portion 552. In some embodiments, the second portion 552 of the second bracket section 510 defines a width greater than a width of the first portion 550 of the second bracket section 510.

As shown, the bracket 502 includes a second portion 552 with of a reduced height which may be suitable for connections with other components of the framing assembly 100. In addition, in lieu of slits, the bracket 502 comprises a first recess 530 defined along the first side 549 of the second bracket section 510 and a second recess 532 defined along the second side 551 of the second bracket section 510.

As further shown, the first bracket section 508 of the bracket 502 includes a plurality of sides 572, 574, 576, 578, 580, 582 and 584 defined along a periphery of the first bracket section 508. The plurality of sides 572, 574, 576, 578, 580, 582 and 584 may be contiguous, and each of the plurality of sides 572, 574, 576, 578, 580, 582 and 584 may be substantially linear or otherwise devoid of curvature as shown. In particular, the side 574 and the side 582 assist to engage and generate friction against a joist to hold the bracket 502 in place against the joist flanges. The plurality of sides 572, 574, 576, 578, 580, 582 and 584 of the first bracket section 508 may define a plurality of corners 586A-586F along the first bracket section 508 as shown. In some embodiments, the bracket 502 defines a first sidewall 560 and a second sidewall 562 defined along the second bracket section 510 by virtue of the recess 530 and the recess 532 respectively. In some embodiments, the first bracket section 508 may further include at least one aperture 590 or slot 592 configured to receive a securing member (not shown) such as a screw or a bolt to facilitate anchoring of the bracket 502 to components of the framing assembly 100, such as the joist 104.

Utilizing an attachment sequence similar to FIGS. 9-12, the bracket 502 is configured for snap-engagement to a joist utilizing the novel arrangement of the first bracket section 508 with the plurality of corners 586A-586F, which frees up hands of a builder to secure the bracket 502 more permanently to other framing components. In some embodiments, the bracket 502 further includes one or more apertures (not shown) similar to the apertures 129 of the bracket 102 to guide the second bracket section 510 to a predetermined position within a joist interior portion.

In some embodiments, the first bracket section 508 of the bracket 502 is sized slightly wider than a width of a web of a joist; i.e., the distance between the flanges of the joist. In such embodiments, the first bracket section 508 may be bent slightly, to couple the bracket 502 to the joist within a joist interior portion. Specifically for example (not shown), the first bracket section 508 may be sized slightly wider than the web 134 of the joist 104, and the first bracket section 508 may be bent or otherwise flex inwardly upon itself along the side 582 and also along the side 574 to position the first bracket section 508 within the joist interior portion 146 between the flange 136 and the flange 138 of the joist 104.

Figure 16A:
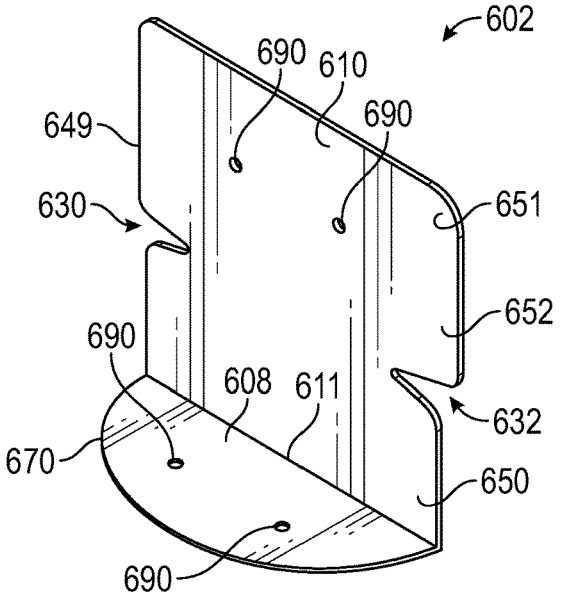
FIG. 16A is a perspective view of a fifth embodiment of a bracket for use with the framing assembly of FIG. 1, according to aspects of the present disclosure.
Figure 16B:
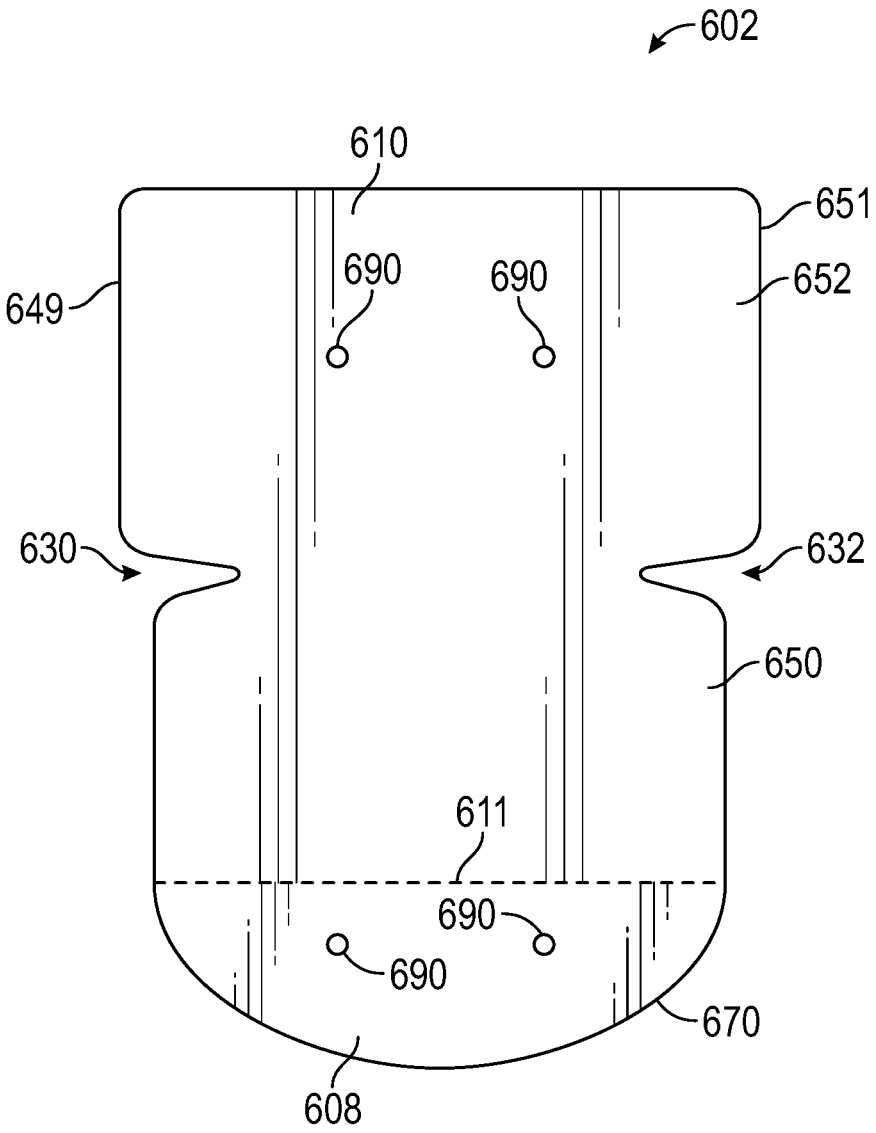
FIG. 16B is a plan view of the bracket of FIG. 16A, according to aspects of the present disclosure.

Referring to FIGS. 16A-16B, another embodiment of a bracket, designated 602, for interconnecting components of the framing assembly 100 is illustrated. The bracket 602 defines a first bracket section 608, and second bracket section 610 in communication with the first bracket section 608 along a bracket bend 611. In some embodiments, the first bracket section 608 is aligned in perpendicular relation relative to the second bracket section 610 along the bracket bend 611 such that the bracket 602 defines a general L-shaped configuration or 90 degree bracket. As shown, the second bracket section 610 of the bracket 602 includes a first side 649, and a second side 651. Further, the second bracket section 610 may define a first portion 650 and a second portion 652 in communication with the first portion 650. In some embodiments, the second portion 652 of the second bracket section 610 defines a width greater than a width of the first portion 650 of the second bracket section 610.

In some embodiments, the bracket defines a first slit 630 along the first side 649 of the second bracket section 610, and a second slit 632 along the second side 651 of the second bracket section 610 as shown. The first slit 630 and the second slit 632 may define a tapered or triangular shape similar to the first slit 130 and the second slit 132 of the bracket 102. As shown, the first slit 630 and the second slit 632 may be aligned in parallel orientation along the second bracket section 610.

As shown, the first bracket section 608 of the bracket 602 may define a generally radial side 670 having a semi-circular shape, which may define one or more radial edges (not shown) along the periphery of the radial side 670 and be sized to provide some resistance to rotation within a joist interior portion. In some embodiments, the second bracket section 610 may further include at least one aperture 690 or slot (not shown) configured to receive a securing member (not shown) such as a screw or a bolt to facilitate anchoring of the bracket 602 to components of the framing assembly 100, such as the joist 104.

Figure 17:
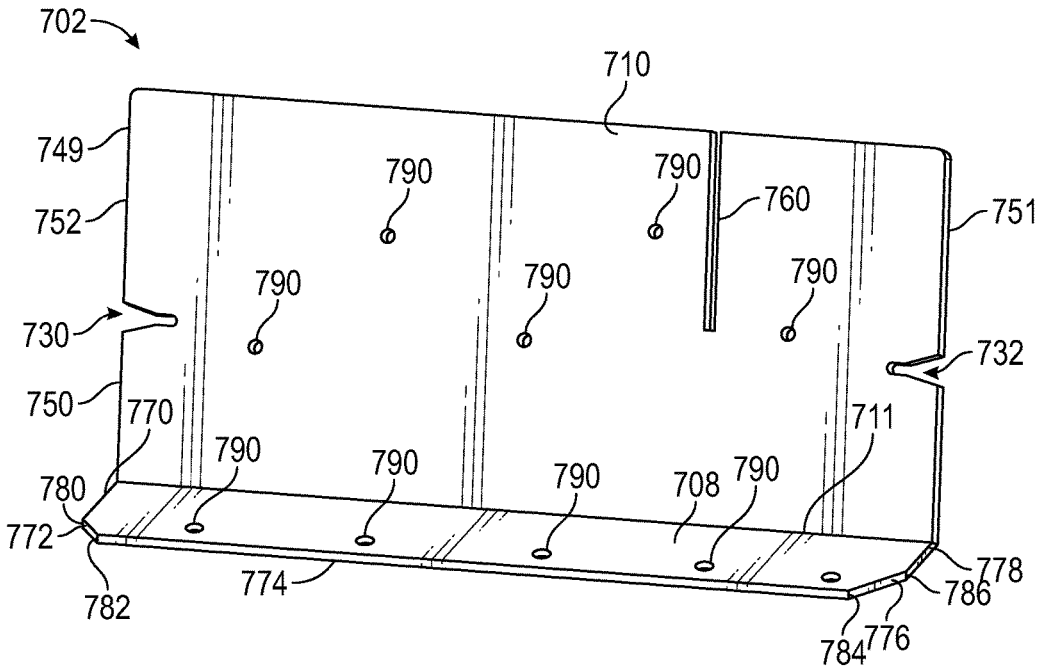
FIG. 17 is a perspective view of a sixth embodiment of a bracket for use with the framing assembly of FIG. 1, according to aspects of the present disclosure.
Figure 18:
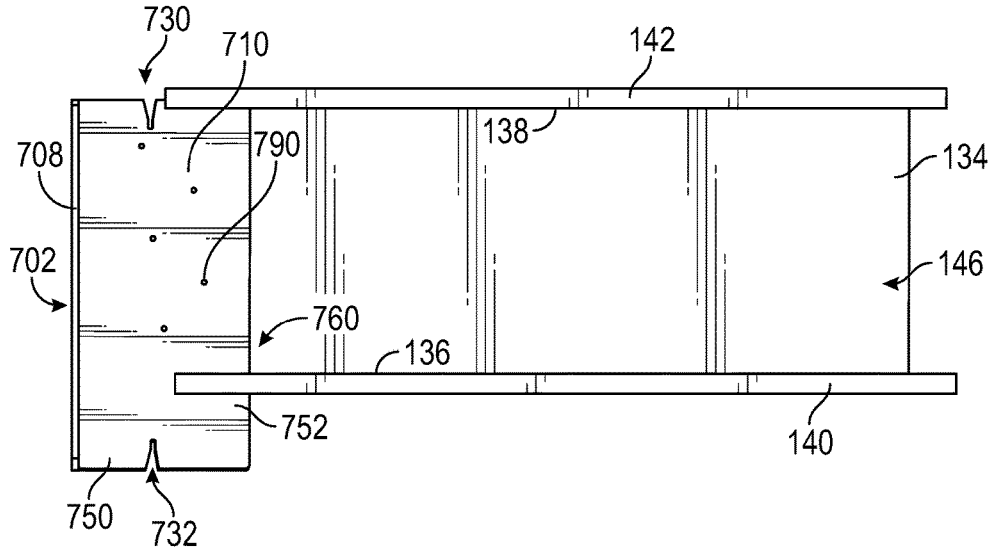
FIG. 18 is a top view of the bracket of FIG. 17 engaged to a joist, according to aspects of the present disclosure.

Referring to FIGS. 17-18, another embodiment of a bracket, designated 702, for interconnecting components of the framing assembly 100 is illustrated. The bracket 702 defines a first bracket section 708, and second bracket section 710 in communication with the first bracket section 708 along a bracket bend 711. In some embodiments, the first bracket section 708 is aligned in perpendicular relation relative to the second bracket section 710 along the bracket bend 711 such that the bracket 702 defines a general L-shaped configuration or 90 degree bracket. As shown, the second bracket section 710 of the bracket 702 includes a first side 749, and a second side 751. Further, the second bracket section 710 may define a first portion 750 and a second portion 752 in communication with the first portion 750. In some embodiments, the second portion 752 of the second bracket section 710 defines a width greater than a width of the first portion 750 of the second bracket section 710.

In some embodiments, the bracket defines a first slit 730 along the first side 749 of the second bracket section 710, and a second slit 732 along the second side 751 of the second bracket section 710 as shown. The first slit 730 and the second slit 732 may define a tapered or triangular shape similar to the first slit 130 and the second slit 132 of the bracket 102. As shown, the first slit 730 and the second slit 732 may be aligned in parallel orientation along the second bracket section 710.

As further shown, the first bracket section 708 of the bracket 702 includes a plurality of sides 770, 772, 774, 776 and 778 defined along a periphery of the first bracket section 708 similar to the bracket 102. The plurality of sides 770, 772, 774, 776 and 778 may be contiguous, and each of the plurality of sides 770, 772, 774, 776 and 778 may be substantially linear or otherwise devoid of curvature as shown. The plurality of sides 770, 772, 774, 776 and 778 of the first bracket section 708 may define a plurality of corners 780, 782, 784, and 786 along the first bracket section 708 as shown. In some embodiments, the orientation of the plurality of sides 770, 772, 774, 776 and 778 relative to one another may collectively define a pentagonal shape of the first bracket section 708. In some embodiments, the bracket 702 may further include at least one aperture 790 or slot (not shown) configured to receive a securing member (not shown) such as a screw or a bolt to facilitate anchoring of the bracket 702 to components of the framing assembly 100, such as the joist 104.

Utilizing an attachment sequence similar to FIGS. 9-12, the bracket 702 is configured for snap-engagement to a joist utilizing the novel arrangement of the first bracket section 708 with the plurality of corners 780, 782, 784, and 786 and the slits 730 and 732, which frees up hands of a builder to secure the bracket 702 more permanently to other framing components.

As further illustrated, the bracket 702 may include a slot 760 defined within the second portion 752 of the second bracket section 710. The slot 760 may be suitable for receiving a flange, such as the flange 136 indicated in FIG. 18. The slot 760 may be implemented in any one of the embodiments of the bracket disclosed herein and facilitates different connections of the framing assembly 100. In some embodiments, the bracket 102 may include multiple slots similar to the slot 760 to adjoin different joists or other components of the framing assembly 100.

Figure 19:
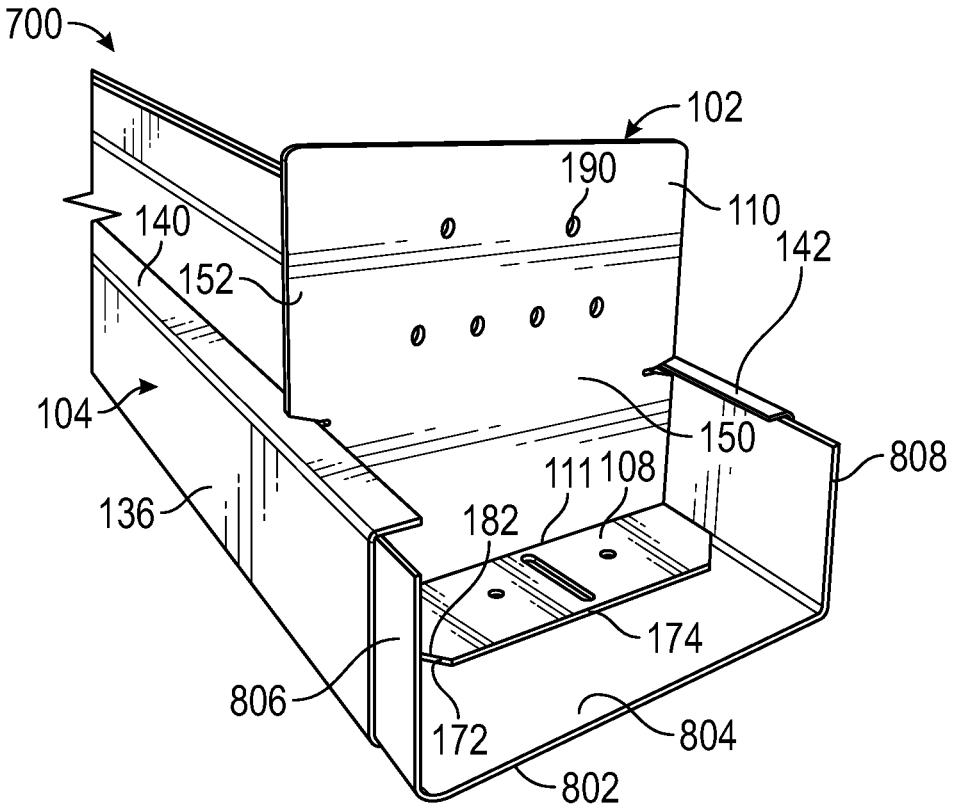
FIG. 19 is a perspective view of the bracket of FIG. 8A engaged to a joist, showing an insert positioned between the joist and the bracket, according to aspects of the present disclosure.

FIG. 19 illustrates an insert 802 which may be interposed between a bracket, such as the bracket 102, and the joist 104 to tighten the connection between the joist 104 and the bracket 102. The insert 802 includes a middle portion 804, and flanges 806 and 808 defined at opposing sides of the middle portion 804 similar to the joists described herein. The insert 802 may be oriented within the joist interior portion 146 of the joist 104 with the flange 806 aligned substantially along the interior of the flange 136 of the joist 104, the middle portion 804 aligned over the web 134, and the flange 808 aligned substantially along the flange 138 of the joist 104.

The insert 802 provides a variety of advantages. Namely, the insert 802 reinforces an existing joist such as the joist 104. As shown, the insert 802 slides into the joist interior portion 146 and increases the span of the joist 104 when addressing height restrictions or to otherwise modify the space associated with the joist interior portion 146. The insert 802 may further allow for easier and stronger connections to the bracket 102 and can be pre-disposed within the joist interior portion 146 for easier shipping and construction. In other embodiments, the insert 802 may be flipped relative to the joist 104. As such, the insert 802 may cover the joist interior portion 146 and be positioned with the middle portion 804 disposed over the web 134 and the first bracket section 108, the flange 806 aligned substantially along the interior of the flange 136, and the flange 808 aligned substantially along the flange 138.

Figure 20:
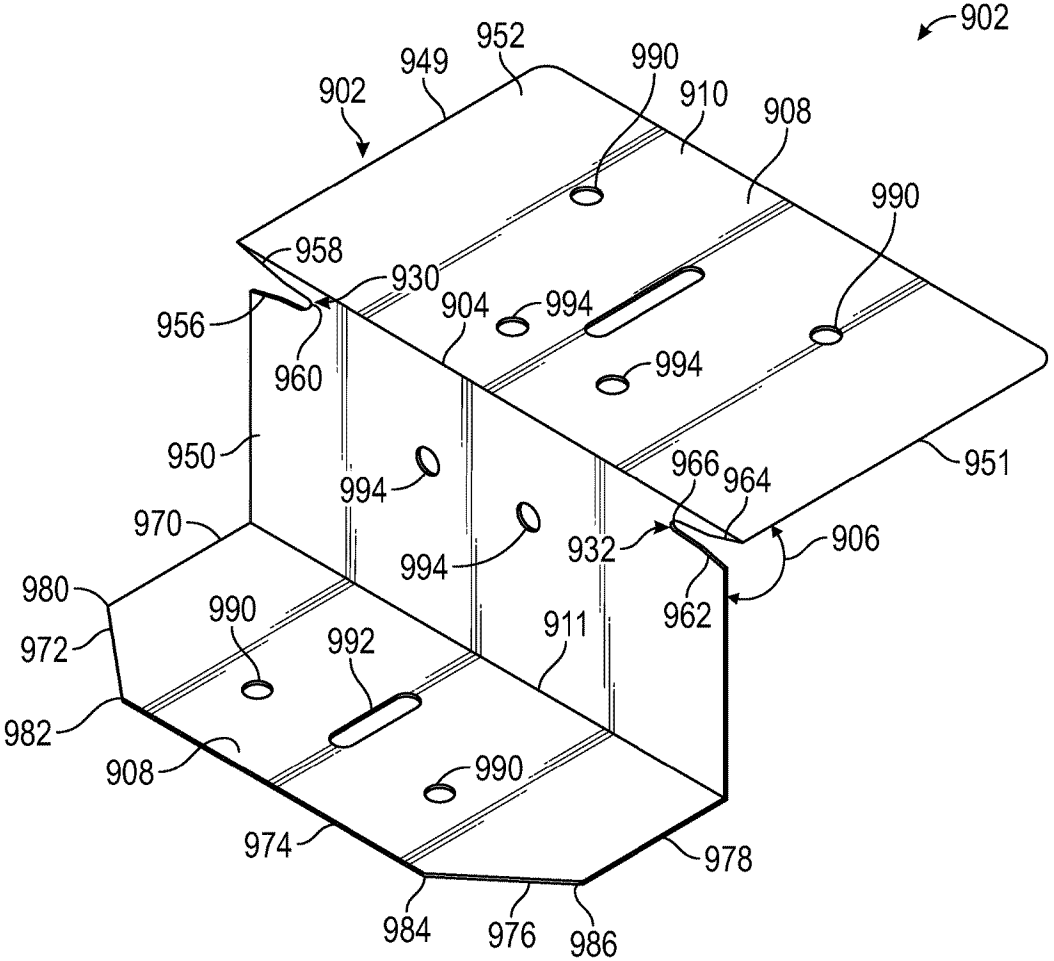
FIG. 20 is a perspective view of a seventh embodiment of a bracket for use with the framing assembly of FIG. 1 similar to the bracket of FIG. 8A, according to aspects of the present disclosure.

Referring to FIG. 20, one additional embodiment of a bracket 902 for interconnecting components of the framing assembly 100 is illustrated. The bracket 902 defines a first bracket section 908, and second bracket section 910 in communication with the first bracket section 908 along a bracket bend 911. In some embodiments, the first bracket section 908 is aligned in perpendicular relation relative to the first portion 950 of the second bracket section 910 along the bracket bend 911.

The second bracket section 910 of the bracket 902 defines a first portion 950 defined along the bracket bend 911 and a second portion 952 in communication with the first portion 950. In some embodiments, the second portion 950 is bent in a direction away from the first bracket section 108 along a bracket bend 904 to define an angle 906. In other words, the bracket bend 904 is defined between the first portion 950 and the second portion 952, and the angle 906 is defined by the first portion 950 and the second portion 952 by virtue of the bracket bend 904. The angle 906 may be within a range of approximately 60 to 120 degrees, and in some embodiments, may be substantially close or equal to 90 degrees similar to the bracket bend 911. In this manner, the second portion 952 extends along a horizontal plane 908 that is substantially parallel with the first bracket section 908, such that the bracket 902 defines a general S-shaped configuration.

In some embodiments, the bracket defines a first slit 930 along the first side 949 of the second bracket section 910, and a second slit 932 along the second side 951 of the second bracket section 910 as shown. The first slit 930 and the second slit 932 may define a tapered or triangular shape similar to the first slit 130 and the second slit 132 of the bracket 102. As shown, the first slit 930 and the second slit 932 may be aligned in parallel orientation along the second bracket section 910. As further shown, the second bracket section 910 of the bracket 902 includes a first side 949, and an opposite second side 951. In some embodiments, the second portion 952 of the second bracket section 910 defines a width greater than a width of the first portion 950 of the second bracket section 910.

As further illustrated, the first bracket section 908 of the bracket 902 includes a plurality of sides 970, 972, 974, 976 and 978 defined along a periphery of the first bracket section 908 similar to the bracket 102. The plurality of sides 970, 972, 974, 976 and 978 may be contiguous, and each of the plurality of sides 970, 972, 974, 976 and 978 may be substantially linear or otherwise devoid of curvature as shown. The plurality of sides 970, 972, 974, 976 and 978 of the first bracket section 908 may define a plurality of corners 980, 982, 984 and 986 along the first bracket section 908 as shown. In some embodiments, the orientation of the plurality of sides 970, 972, 974, 976 and 978 relative to one another may collectively define a pentagonal shape of the first bracket section 908. In some embodiments, the second bracket section 910 may further include at least one aperture 990 or slot 992 configured to receive a securing member (not shown) such as a screw or a bolt to facilitate anchoring of the bracket 902 to components of the framing assembly 100, such as the joist 104.

Utilizing an attachment sequence similar to FIGS. 9-12, the bracket 902 is configured for snap-engagement to a joist utilizing the novel arrangement of the first bracket section 908 with the plurality of corners 980, 982, 984 and 986 and the slits 930 and 932, which frees up hands of a builder to secure the bracket 902 more permanently to other framing components as described herein. In some embodiments, the bracket 902 further includes one or more apertures (not shown) similar to the apertures 129 of the bracket 102 to guide the second bracket section 910 to a predetermined position within a joist interior portion.

Utilizing the brackets disclosed, the components of the framing assembly may be mechanically coupled together and held in place by gravity and friction such that free hands may be used to permanently fasten the components of the framing assembly together. For example, the brackets may be fabricated with a size slightly smaller than the size of the joists so that e.g. the first bracket section or second bracket section may fit snug within the joist interior portion of the joist. Because the components can be held in place and attached together with minimal or no amount of tools, the disclosed framing assembly is both easier and quicker to build.

In some embodiments, any one of the brackets described above may be skewable or bent to morph or modify the brackets for different framing assembly configurations. For example, the second bracket section 110 of the bracket 102 may be skewable relative to the first bracket section 108 along the bracket bend 111 to adjust the angle of the second bracket section 110 relative to the first bracket section 108 away from the substantially 90 degree bracket bends shown. In other embodiments, the second bracket section 110 may further be twisted in a horizontal direction as needed for a particular configuration of the framing assembly 100.

The aforementioned brackets and other framing components may comprise steel. Steel framing is an ideal construction choice due to its various advantages over common lumber. For example, steel retains its rigidity, straightness and also resists warping. Steel is also stronger than lumber, lightweight, recyclable, and renewable and can be protected against the elements using galvanization and coatings. Further, steel is versatile as it can be bent and manipulated to different orientations and shapes depending on the particular application. The aforementioned components of the framing assembly may further have at least one coating for treating and/or preparing the components which may be applied prior to, during, and/or after assembly of the framing assembly.

The disclosed framing assembly may be utilized for a variety of different applications. As one example, the framing assembly may be used for providing a deck and disposing a deck or cover over the framing assembly. The framing assembly may further be utilized as part of a temporary or permanent pool cover. The framing assembly may further be utilized for more general construction applications such as building a wall, floor, or a roof. Ultimately, the disclosed framing assembly may assist the average homeowner or handyman to be able to build a frame or framing assembly. The described framing assembly lowers the expertise level needed and time requirements for assembly to a level below a normal contracting expert such as a common handyman or even a novice homeowner. The disclosed framing assembly provides a reduced build time, is easier to use, more adaptable to different structures or applications, and provides a more accurate frame. The framing assembly may further involve smaller, more modular components and connectors which can be shipped more easily to and from different locations—in sharp contrast to the larger components implemented with conventional framing assemblies which are often required to be cut prior to shipping or require special shipping arrangements.

It is believed that the present disclosure and many of its attendant advantages should be understood by the foregoing description, and it should be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it should be understood that these embodiments are illustrative and that the scope of the disclosure is not limited to such embodiments. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A framing assembly, comprising:

a bracket comprising a first bracket section in communication with a second bracket section with a bracket bend defined between the first bracket section and the second bracket section, the first bracket section aligned in perpendicular relation relative to the second bracket section along the bracket bend;

a first slit and a second slit defined along the second bracket section, the first slit defined along a first lateral side of the second bracket section and the second slit defined along a second lateral side of the second bracket section opposite the first slit, the first slit defining a first width and a second width, wherein the second width of the first slit is greater than the first width of the first slit; and a plurality of linear sides defined along a periphery of the first bracket section, the plurality of linear sides including a first linear side extending orthogonally from the first lateral side of the second bracket section and a second linear side in communication with the first linear side at a corner of the first bracket section, the first bracket section defining a pentagonal shape, wherein the bracket is configured to frictionally interconnect components of the framing assembly including being configured to connect with a joist such that the first bracket section is aligned between opposing flanges of the joist and the first slit and the second slit of the bracket receive opposing returns of the joist.

2. The framing assembly of claim 1, wherein the second bracket section comprises:

a first portion of the second bracket section in communication with the first bracket section, the first portion of the second bracket section defining a first width, and a second portion of the second bracket section in communication with the first portion of the second bracket section, the second portion defining a second width greater than the first width of the first portion.

3. The framing assembly of claim 2, wherein the first slit is defined by:

a first sidewall defined along a top edge of the first portion of the second bracket section, a second sidewall opposing the first sidewall, the second sidewall defined along a bottom edge of the second portion of the second bracket section, and an interior point defined at an intersection of the first sidewall and the second sidewall.

4. The framing assembly of claim 3, further comprising:

wherein the first sidewall of the first slit extends along a first axis and the second sidewall of the first slit extends along a second axis, and wherein an intersection of the first axis and the second axis at the interior point defines an acute angle.

5. The framing assembly of claim 4, wherein the second sidewall defines a second sidewall width greater than a first sidewall width defined by the first sidewall.

6. The framing assembly of claim 5, wherein the first bracket section is entirely planar.

7. The framing assembly of claim 6, wherein the second bracket section is entirely planar.

8. The framing assembly of claim 7, wherein the plurality of linear sides defines five contiguous linear sides and four corners formed at a distance from the second bracket section.

9. The framing assembly of claim 8, wherein the joist comprises a web, a first flange of the opposing flanges defined along a first side of the web, a first return of the opposing returns defined along the first flange, a second flange of the opposing flanges defined along a second side of the web opposite the first flange, and a second return of the opposing returns defined along the second flange opposite the first return, the joist further comprising a joist interior portion defined collectively by the web, the first flange, the second flange, the first return, and the second return.

10. The framing assembly of claim 9, wherein:

the first slit of the bracket is configured to receive the first return of the joist and the second slit of the bracket is configured to receive the second return of the joist, and the first bracket section of the bracket and the first portion of the second bracket section are configured to be received within the joist interior portion such that the first portion of the second bracket section is aligned between the first flange and the second flange of the joist and the second portion of the second bracket section is disposed over the first return and the second return of the joist.

11. The framing assembly of claim 10, wherein a degree of friction is generated between the first return of the joist and the first sidewall and the second sidewall of the first slit.

12. The framing assembly of claim 11, wherein the first return and the second return of the joist overlap the first sidewall and partially overlap the first portion of the second bracket section.

13. The framing assembly of claim 12, wherein the second portion of the second bracket section at least partially overlaps the first return and the second return of the joist.

14. The framing assembly of claim 13, wherein a first gap is defined between the first sidewall and a bottom side of the first return and a second gap is defined between a top side of the first return and the second sidewall.

15. The framing assembly of claim 14, wherein a length of the first bracket section is sized according to a predetermined desired amount of contact interference between the bracket and interior surfaces of the joist defined by the web, the first flange, and the second flange.

16. The framing assembly of claim 15, further comprising:

an insert disposed between the joist and the bracket, the insert comprising a middle portion extending along the web of the joist.

17. The framing assembly of claim 16, wherein the corner is configured to align along the first flange of the joist.

18. The framing assembly of claim 17, further comprising:

a third slit defined along the first lateral side of the second bracket section adjacent the first slit; and a fourth slit defined along the second lateral side of the second bracket section opposite the third slit and adjacent the second slit.

19. The framing assembly of claim 18, further comprising:

a slot formed in the second bracket section between the first lateral side and the second lateral side.

20. The framing assembly of claim 1, further comprising:

wherein the second bracket section is configured to be coupled with an additional joist such that the bracket is configured to interconnect the joist with the additional joist as part of constructing the framing assembly.

21. A method of making a framing assembly, comprising:

providing a first joist, the first joist including a web, a first flange defined along a first side of the web, a first return defined along the first flange, a second flange defined along a second side of the web opposite the first flange, and a second return defined along the second flange opposite the first return;

providing a bracket, comprising a first bracket section in communication with a second bracket section with a bracket bend defined between the first bracket section and the second bracket section, a first slit defined along a first lateral side of the second bracket section and a second slit defined along a second lateral side of the second bracket section opposite the first lateral side, and a plurality of linear sides defined along a periphery of the first bracket section, the plurality of linear sides including a first linear side and a second linear side defining a first corner, the plurality of linear sides further defining a second corner defined between the first lateral side and the second lateral side of the bracket;

disposing the first bracket section over the web of the first joist between the first flange and the second flange of the first joist such that the second linear side is flush with the first flange and the first corner is oriented at a first location along the first flange;

rotating the bracket in a direction relative to the first joist to align the first corner at a second location such that the first corner is oriented towards the first flange;

positioning the first return of the first joist through the first slit and the second return of the first joist through the second slit; and applying a force in the direction to rotate the bracket such that the first linear side is aligned along the first flange and the first corner is oriented in a third location along the first flange.

22. The method of claim 21, wherein the first corner in the second location directly contacts and abuts the first flange and provides a resistance to a rotation in the direction, and the force causes the bracket to overcome the resistance such that the first corner passes to the second location.

23. The method of claim 21, further comprising:

disposing an insert between the bracket and the first joist, the insert comprising an insert middle portion, and a pair of insert flanges aligned along lateral sides of the insert middle portion.

24. The method of claim 21, further comprising:

sliding the first bracket section of the bracket within a first joist interior portion of the first joist to a predetermined location between respective ends of the first joist, the first joist interior portion defined collectively by the web, the first flange, the second flange, the first return, and the second return; and mounting the bracket to the first joist using at least one coupling member.

25. The method of claim 21, further comprising:

providing a second joist, the second joist comprising opposing flanges and opposing returns defined along the opposing flanges; and sliding the second bracket section between the opposing flanges of the second joist.

26. A framing assembly, comprising:

a bracket, comprising a first bracket section in communication with a second bracket section with a bracket bend defined between the first bracket section and the second bracket section;

a first slit defined along a first lateral side of the second bracket section; and a second slit defined along a second lateral side of the second bracket section opposite the first slit, wherein the first bracket section defines a plurality of linear sides along a periphery of the first bracket section, and an obtuse angle is formed at a corner defined between two of the plurality of linear sides, and wherein the first bracket section is configured to align between opposing flanges of a joist and the first slit and the second slit of the bracket are configured to receive opposing returns of the joist.

* * * * *